US009316997B2

(12) United States Patent
Ueda et al.

(10) Patent No.: US 9,316,997 B2
(45) Date of Patent: Apr. 19, 2016

(54) IMAGE FORMING APPARATUS THAT SELECTIVELY RECYCLES DEVELOPER

(71) Applicants: Tetsuto Ueda, Kanagawa (JP); Hiroomi Tamura, Kanagawa (JP); Kazuya Saitoh, Kanagawa (JP); Sho Sekiguchi, Kanagawa (JP); Hirokatsu Suzuki, Kanagawa (JP); Takeshi Kojima, Kanagawa (JP); Takuma Iwasaki, Tokyo (JP)

(72) Inventors: Tetsuto Ueda, Kanagawa (JP); Hiroomi Tamura, Kanagawa (JP); Kazuya Saitoh, Kanagawa (JP); Sho Sekiguchi, Kanagawa (JP); Hirokatsu Suzuki, Kanagawa (JP); Takeshi Kojima, Kanagawa (JP); Takuma Iwasaki, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/622,213

(22) Filed: Feb. 13, 2015

(65) Prior Publication Data

US 2015/0227108 A1 Aug. 13, 2015

(30) Foreign Application Priority Data

Feb. 13, 2014 (JP) ..... 2014025912

(51) Int. Cl.
*G03G 21/10* (2006.01)

(52) U.S. Cl.
CPC ..... *G03G 21/105* (2013.01)

(58) Field of Classification Search
CPC ..... G03G 21/10; G03G 21/105
See application file for complete search history.

(56) References Cited

U.S. PATENT DOCUMENTS

| | | | | |
|---|---|---|---|---|
| 2005/0232669 | A1* | 10/2005 | Ishikawa | G03G 21/12 399/358 |
| 2008/0280225 | A1 | 11/2008 | Konishi et al. | |
| 2011/0194864 | A1 | 8/2011 | Nakatake et al. | |
| 2013/0011171 | A1 | 1/2013 | Tamura et al. | |
| 2013/0156466 | A1 | 6/2013 | Bisaiji et al. | |
| 2013/0164053 | A1 | 6/2013 | Bisaiji et al. | |

FOREIGN PATENT DOCUMENTS

| | | |
|---|---|---|
| JP | 2002-072808 | 3/2002 |
| JP | 2005-308861 | 11/2005 |
| JP | 2006-119309 | 5/2006 |
| JP | 2006-337699 | 12/2006 |
| JP | 2007-086660 | 4/2007 |
| JP | 2008-281844 | 11/2008 |
| JP | 2011-164334 | 8/2011 |

* cited by examiner

*Primary Examiner* — David Gray
*Assistant Examiner* — Laura Roth
(74) *Attorney, Agent, or Firm* — Duft Bornsen & Fettig LLP

(57) ABSTRACT

An image forming apparatus that includes an image bearer, a developing device to develop a latent image, a transfer device to transfer a developed image from the image bearer, a developer collecting device to collect developer remaining on the image bearer, and a waste-developer container to contain developer to be disposed. The apparatus also includes a switching determiner to perform a determination of a preferred transfer amount of developer in a target period, an estimation of an accumulative consumption of developer in the target period, a determination of whether to dispose or reuse collected developer, and a determination of whether to perform switching between disposal and reuse of the collected developer based on comparison between the preferred transfer amount and the estimated accumulative consumption of developer. The apparatus also includes a switching controller to cause the developer collecting device to perform the switching between disposal and reuse.

19 Claims, 26 Drawing Sheets

FIG. 22A

| ADJUSTMENT COEFFICIENT \ HUMIDITY H (%) | H ≤ 40 | 40<H<60 | 60 ≤ H |
|---|---|---|---|
| α | 0.8 | 1 | 1.2 |
| β | −10 | 0 | 10 |

FIG. 22B

| ADJUSTMENT COEFFICIENT \ TEMPERATURE T (°C) | T ≤ 20 | 20<T<35 | 35 ≤ T |
|---|---|---|---|
| α | 0.8 | 1 | 1.2 |
| β | −10 | 0 | 10 |

FIG. 22C

| ADJUSTMENT COEFFICIENT \ REUSED TONER AMOUNT R (mg) | R ≤ 50 | 50<R<150 | 150 ≤ R |
|---|---|---|---|
| α | 1 | 1.1 | 1.2 |
| β | 0 | 20 | 40 |

FIG. 22D

| ADJUSTMENT COEFFICIENT \ TRANSFER PACE Tr (mg/sec) | Tr ≤ 20 | 20<Tr<40 | 40 ≤ Tr |
|---|---|---|---|
| α | 1 | 1.1 | 1.2 |
| β | 0 | 20 | 40 |

FIG. 22E

| ADJUSTMENT COEFFICIENT \ PAPER DUST AMOUNT P (mg) | P ≤ 5 | 5<P<10 | 10 ≤ P |
|---|---|---|---|
| α | 0.8 | 1 | 1.2 |
| β | 0 | 10 | 20 |

FIG. 22F

| ADJUSTMENT COEFFICIENT \ SMOOTHNESS S | S ≤ 5 | 5<S<10 | 10 ≤ S |
|---|---|---|---|
| α | 1.2 | 1 | 0.8 |
| β | 20 | 10 | 0 |

FIG. 22G

| ADJUSTMENT COEFFICIENT \ DRIVING AMOUNT D1 (km) | D1 ≤ 20 | 20<D1<40 | 40 ≤ D1 |
|---|---|---|---|
| α | 1 | 1.1 | 1.2 |
| β | 0 | 20 | 40 |

FIG. 22H

| ADJUSTMENT COEFFICIENT \ DRIVING AMOUNT D2 (km) | D2 ≤ 20 | 20<D2<40 | 40 ≤ D2 |
|---|---|---|---|
| α | 1 | 1.1 | 1.2 |
| β | 0 | 20 | 40 |

FIG. 22I

| ADJUSTMENT COEFFICIENT \ BACKGROUND FOG AMOUNT B (mg) | B ≤ 0.1 | 0.1<B<0.3 | 0.3 ≤ B |
|---|---|---|---|
| α | 1.2 | 1 | 0.8 |
| β | 20 | 0 | −20 |

FIG. 23A

| ADJUSTMENT COEFFICIENT \ HUMIDITY H (%) | H ≤ 40 | 40<H<60 | 60 ≤ H |
|---|---|---|---|
| α | 1.2 | 1 | 0.8 |
| β | 10 | 0 | −10 |

FIG. 23B

| ADJUSTMENT COEFFICIENT \ TEMPERATURE T (°C) | T ≤ 20 | 20<T<35 | 35 ≤ T |
|---|---|---|---|
| α | 1.2 | 1 | 0.8 |
| β | 10 | 0 | −10 |

FIG. 23C

| ADJUSTMENT COEFFICIENT \ REUSED TONER AMOUNT R (mg) | R ≤ 50 | 50<R<150 | 150 ≤ R |
|---|---|---|---|
| α | 1 | 0.9 | 0.8 |
| β | 0 | −20 | −40 |

FIG. 23D

| ADJUSTMENT COEFFICIENT \ TRANSFER PACE Tr (mg/sec) | Tr ≤ 20 | 20<Tr<40 | 40 ≤ Tr |
|---|---|---|---|
| α | 1 | 0.9 | 0.8 |
| β | 0 | −20 | −40 |

FIG. 23E

| ADJUSTMENT COEFFICIENT \ PAPER DUST AMOUNT P (mg) | P ≤ 5 | 5<P<10 | 10 ≤ P |
|---|---|---|---|
| α | 1.2 | 1 | 0.8 |
| β | 20 | 10 | 0 |

FIG. 23F

| ADJUSTMENT COEFFICIENT \ SMOOTHNESS S | S ≤ 5 | 5<S<10 | 10 ≤ S |
|---|---|---|---|
| α | 0.8 | 1 | 1.2 |
| β | 0 | 10 | 20 |

FIG. 23G

| ADJUSTMENT COEFFICIENT \ DRIVING AMOUNT D1 (km) | D1 ≤ 20 | 20<D1<40 | 40 ≤ D1 |
|---|---|---|---|
| α | 1.2 | 1.1 | 1 |
| β | 40 | 20 | 0 |

FIG. 23H

| ADJUSTMENT COEFFICIENT \ DRIVING AMOUNT D2 (km) | D2 ≤ 20 | 20<D2<40 | 40 ≤ D2 |
|---|---|---|---|
| α | 1.2 | 1.1 | 1 |
| β | 40 | 20 | 0 |

FIG. 23I

| ADJUSTMENT COEFFICIENT \ BACKGROUND FOG AMOUNT B (mg) | B ≤ 0.1 | 0.1<B<0.3 | 0.3 ≤ B |
|---|---|---|---|
| α | 0.8 | 1 | 1.2 |
| β | −20 | 0 | 20 |

FIG. 24A

| ADJUSTMENT COEFFICIENT \ HUMIDITY H (%) | H ≤ 40 | 40<H<60 | 60 ≤ H |
|---|---|---|---|
| α | 0.8 | 1 | 1.2 |
| β | 1.2 | 1 | 0.8 |

FIG. 24B

| ADJUSTMENT COEFFICIENT \ TEMPERATURE T (°C) | T ≤ 20 | 20<T<35 | 35 ≤ T |
|---|---|---|---|
| α | 0.8 | 1 | 1.2 |
| β | 1.2 | 1 | 0.8 |

FIG. 24C

| ADJUSTMENT COEFFICIENT \ REUSED TONER AMOUNT R (mg) | R ≤ 50 | 50<R<150 | 150 ≤ R |
|---|---|---|---|
| α | 1 | 1.1 | 1.2 |
| β | 1 | 0.9 | 0.8 |

FIG. 24D

| ADJUSTMENT COEFFICIENT \ TRANSFER PACE Tr (mg/sec) | Tr ≤ 20 | 20<Tr<40 | 40 ≤ Tr |
|---|---|---|---|
| α | 1 | 1.1 | 1.2 |
| β | 1 | 0.9 | 0.8 |

FIG. 24E

| ADJUSTMENT COEFFICIENT \ PAPER DUST AMOUNT P (mg) | P ≤ 5 | 5<P<10 | 10 ≤ P |
|---|---|---|---|
| α | 0.8 | 1 | 1.2 |
| β | 1.2 | 1 | 0.8 |

FIG. 24F

| ADJUSTMENT COEFFICIENT \ SMOOTHNESS S | S ≤ 5 | 5<S<10 | 10 ≤ S |
|---|---|---|---|
| α | 1.2 | 1 | 0.8 |
| β | 0.8 | 1 | 1.2 |

FIG. 24G

| ADJUSTMENT COEFFICIENT \ DRIVING AMOUNT D1 (km) | D1 ≤ 20 | 20<D1<40 | 40 ≤ D1 |
|---|---|---|---|
| α | 1 | 1.1 | 1.2 |
| β | 1 | 0.9 | 0.8 |

FIG. 24H

| ADJUSTMENT COEFFICIENT \ DRIVING AMOUNT D2 (km) | D2 ≤ 20 | 20<D2<40 | 40 ≤ D2 |
|---|---|---|---|
| α | 1 | 1.1 | 1.2 |
| β | 1 | 0.9 | 0.8 |

FIG. 24I

| ADJUSTMENT COEFFICIENT \ BACKGROUND FOG AMOUNT B (mg) | B ≤ 0.1 | 0.1<B<0.3 | 0.3 ≤ B |
|---|---|---|---|
| α | 1.2 | 1 | 0.8 |
| β | 0.8 | 1 | 1.2 |

FIG. 25A

| ADJUSTMENT COEFFICIENT \ HUMIDITY H (%) | $0 \leq H \leq 100$ |
|---|---|
| $\alpha$ | $0.02 \times H$ |
| $\beta$ | $H - 50$ |

FIG. 25B

| ADJUSTMENT COEFFICIENT \ TEMPERATURE T (°C) | $-273 \leq T$ |
|---|---|
| $\alpha$ | $0.0267 \times T + 0.2667$ |
| $\beta$ | $1.333 \times T - 36.667$ |

FIG. 25C

| ADJUSTMENT COEFFICIENT \ REUSED TONER AMOUNT R (mg) | $0 \leq R$ |
|---|---|
| $\alpha$ | $0.002 \times R + 0.9$ |
| $\beta$ | $0.4 \times R - 20$ |

FIG. 25D

| ADJUSTMENT COEFFICIENT \ TRANSFER PACE Tr (mg/sec) | $0 \leq Tr$ |
|---|---|
| $\alpha$ | $0.01 \times Tr - 0.8$ |
| $\beta$ | $2 \times Tr - 40$ |

FIG. 25E

| ADJUSTMENT COEFFICIENT \ PAPER DUST AMOUNT P (mg) | $0 \leq P$ |
|---|---|
| $\alpha$ | $0.08 \times P + 0.4$ |
| $\beta$ | $4 \times P - 20$ |

FIG. 25F

| ADJUSTMENT COEFFICIENT \ SMOOTHNESS S | 0 ≤ S |
|---|---|
| α | −0.08 × S + 1.6 |
| β | −4 × S + 40 |

FIG. 25G

| ADJUSTMENT COEFFICIENT \ DRIVING AMOUNT D1 (km) | 0 ≤ D1 |
|---|---|
| α | 0.01 × D1 + 0.8 |
| β | 2 × D1 − 40 |

FIG. 25H

| ADJUSTMENT COEFFICIENT \ DRIVING AMOUNT D2 (km) | 0 ≤ D2 |
|---|---|
| α | 0.01 × D2 + 0.8 |
| β | 2 × D2 − 40 |

FIG. 25I

| ADJUSTMENT COEFFICIENT \ BACKGROUND FOG AMOUNT B (mg) | 0 ≤ B |
|---|---|
| α | −2 × B + 1.4 |
| β | −200 × B + 40 |

FIG. 26A

| ADJUSTMENT COEFFICIENT \ HUMIDITY H (%) | $0 \leq H \leq 100$ |
|---|---|
| $\alpha$ | $-0.02 \times H + 2$ |
| $\beta$ | $-H + 50$ |

FIG. 26B

| ADJUSTMENT COEFFICIENT \ TEMPERATURE T (°C) | $-273 \leq T$ |
|---|---|
| $\alpha$ | $-0.0267 \times T + 1.7333$ |
| $\beta$ | $-1.333 \times T + 36.667$ |

FIG. 26C

| ADJUSTMENT COEFFICIENT \ REUSED TONER AMOUNT R (mg) | $0 \leq R$ |
|---|---|
| $\alpha$ | $-0.002 \times R + 1.1$ |
| $\beta$ | $-0.4 \times R + 20$ |

FIG. 26D

| ADJUSTMENT COEFFICIENT \ TRANSFER PACE Tr (mg/sec) | $0 \leq Tr$ |
|---|---|
| $\alpha$ | $-0.01 \times Tr + 1.2$ |
| $\beta$ | $-2 \times Tr + 40$ |

FIG. 26E

| ADJUSTMENT COEFFICIENT \ PAPER DUST AMOUNT P (mg) | $0 \leq P$ |
|---|---|
| $\alpha$ | $-0.08 \times P + 1.6$ |
| $\beta$ | $-4 \times P + 40$ |

FIG. 26F

| ADJUSTMENT COEFFICIENT \ SMOOTHNESS S | 0 ≤ S |
|---|---|
| α | 0.08 × S + 0.4 |
| β | 4 × S − 20 |

FIG. 26G

| ADJUSTMENT COEFFICIENT \ DRIVING AMOUNT D1 (km) | 0 ≤ D1 |
|---|---|
| α | −0.01 × D1 + 1.4 |
| β | −2 × D1 + 80 |

FIG. 26H

| ADJUSTMENT COEFFICIENT \ DRIVING AMOUNT D2 (km) | 0 ≤ D2 |
|---|---|
| α | −0.01 × D2 + 1.4 |
| β | −2 × D2 + 80 |

FIG. 26I

| ADJUSTMENT COEFFICIENT \ BACKGROUND FOG AMOUNT B (mg) | 0 ≤ B |
|---|---|
| α | 2 × B + 0.6 |
| β | 200 × B − 40 |

FIG. 27A

| ADJUSTMENT COEFFICIENT \ HUMIDITY H (%) | $0 \leq H \leq 100$ |
|---|---|
| $\alpha$ | $0.02 \times H$ |
| $\beta$ | $-0.02 \times H + 2$ |

FIG. 27B

| ADJUSTMENT COEFFICIENT \ TEMPERATURE T (°C) | $-273 \leq T$ |
|---|---|
| $\alpha$ | $0.0267 \times T + 0.2667$ |
| $\beta$ | $-0.0267 \times T + 1.7333$ |

FIG. 27C

| ADJUSTMENT COEFFICIENT \ REUSED TONER AMOUNT R (mg) | $0 \leq R$ |
|---|---|
| $\alpha$ | $0.002 \times R + 0.9$ |
| $\beta$ | $-0.002 \times R + 1.1$ |

FIG. 27D

| ADJUSTMENT COEFFICIENT \ TRANSFER PACE Tr (mg/sec) | $0 \leq Tr$ |
|---|---|
| $\alpha$ | $0.01 \times Tr - 0.8$ |
| $\beta$ | $-0.01 \times Tr + 1.2$ |

FIG. 27E

| ADJUSTMENT COEFFICIENT \ PAPER DUST AMOUNT P (mg) | $0 \leq P$ |
|---|---|
| $\alpha$ | $0.08 \times P + 0.4$ |
| $\beta$ | $-0.08 \times P + 1.6$ |

FIG. 27F

| ADJUSTMENT COEFFICIENT \ SMOOTHNESS S | 0 ≤ S |
|---|---|
| α | −0.08 × S + 1.6 |
| β | 0.08 × S + 0.4 |

FIG. 27G

| ADJUSTMENT COEFFICIENT \ DRIVING AMOUNT D1 (km) | 0 ≤ D1 |
|---|---|
| α | 0.01 × D1 + 0.8 |
| β | −0.01 × D1 + 1.4 |

FIG. 27H

| ADJUSTMENT COEFFICIENT \ DRIVING AMOUNT D2 (km) | 0 ≤ D2 |
|---|---|
| α | 0.01 × D2 + 0.8 |
| β | −0.01 × D2 + 1.4 |

FIG. 27I

| ADJUSTMENT COEFFICIENT \ BACKGROUND FOG AMOUNT B (mg) | 0 ≤ B |
|---|---|
| α | −2 × B + 1.4 |
| β | 2 × B + 0.6 |

IMAGE FORMING APPARATUS THAT SELECTIVELY RECYCLES DEVELOPER

CROSS-REFERENCE TO RELATED APPLICATIONS

This patent application is based on and claims priority pursuant to 35 U.S.C. §119(a) to Japanese Patent Application No. 2014-025912, filed on Feb. 13, 2014, in the Japan Patent Office, the entire disclosure of which is hereby incorporated by reference herein.

BACKGROUND

1. Technical Field

Embodiments of the present invention generally relate to an image forming apparatus, such as a copier, a printer, a facsimile machine, or a multifunction peripheral (i.e., a multifunction machine) having at least two of copying, printing, facsimile transmission, plotting, and scanning capabilities.

2. Description of the Related Art

At present, image forming apparatuses such as printers and facsimile machines to output electronic data and copiers to copy documents are widely used. There are electrophotographic image forming apparatuses that form electrostatic latent images on an image bearer such as a photoconductor drum with laser beams, cause charged developer, such as toner, to adhere to the latent image, thereby developing the latent image into a toner image, transfer the toner image on a sheet of recording media, and fix the toner image on the sheet by heating and pressing the sheet.

When the toner image is transferred from the image bearer onto the sheet, a certain amount of toner remains on the image bearer. Accordingly, after image formation, such toner is removed by a cleaning device and collected in a waste-toner container. The collected toner may be still usable. Disposing the still usable toner is not desirable from the viewpoint of environment and running cost of the apparatus. Additionally, replacement frequency of the waste-toner container increases, thus making the maintenance and management of the apparatus more complicated.

Therefore, reuse of developer collected from the image bearer has been proposed. Reuse of collected developer is preferable since the amount of images produced with an identical amount of developer increases and the amount of waste developer is reduced.

Typical developer used in electrophotographic image forming apparatuses, however, is degraded while being exposed to heat, humidity, and outside air. Developer is also degraded by friction with a developer conveying mechanism, such as a developer conveying screw to spread developer inside a developing device in a main scanning direction. Therefore, developer supplied from an isolated developer bottle to the developing device is gradually degraded with time. The degradation progresses in proportional to increases in the amount of driving of the developer conveying mechanism. Depending on the degree of degradation, image quality is affected. For example, images become smeary, or toner is partly absent in images.

Although reuse of developer can reduce environmental impact, running cost of the apparatus, replacement frequency of waste-toner containers, thereby making the maintenance and management of the apparatus easier, it makes it difficult to guarantee image quality.

Thus, there is trade-off between advantages attained by reuse of developer and image quality guarantee.

SUMMARY

An embodiment of the present invention provides an image forming apparatus that includes an image bearer to bear a latent image; a developing device to develop the latent image with developer; a transfer device to transfer a developed image from the image bearer onto a recording medium; a developer collecting device to collect developer remaining on the image bearer; a waste-developer container to contain developer to be disposed, a switching determiner; and a switching controller. The switching determiner determines a preferred transfer amount meaning an amount of developer to be transferred in a target period; estimates an accumulative consumption of developer in the target period; determines whether to dispose or reuse collected developer collected by the developer collecting device from the image bearer; and determines whether to perform the switching between disposal and reuse of the collected developer based on comparison between the preferred transfer amount and the estimated accumulative consumption of developer. According to determination made by the switching determiner, the switching controller causes the developer collecting device to perform the switching between disposal and reuse of the collected developer.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein:

FIGS. 22A through 22I are examples coefficient setting tables according to an embodiment;

FIGS. 23A through 23I are coefficient setting tables according to an embodiment;

FIGS. 24A through 24I are coefficient setting tables according to an embodiment;

FIGS. 25A through 25I are coefficient calculation tables according to an embodiment;

FIGS. 26A through 26I are coefficient calculation tables according to an embodiment; and FIGS. 27A through 27I are coefficient calculation tables according to an embodiment.

DETAILED DESCRIPTION

Figure 1:
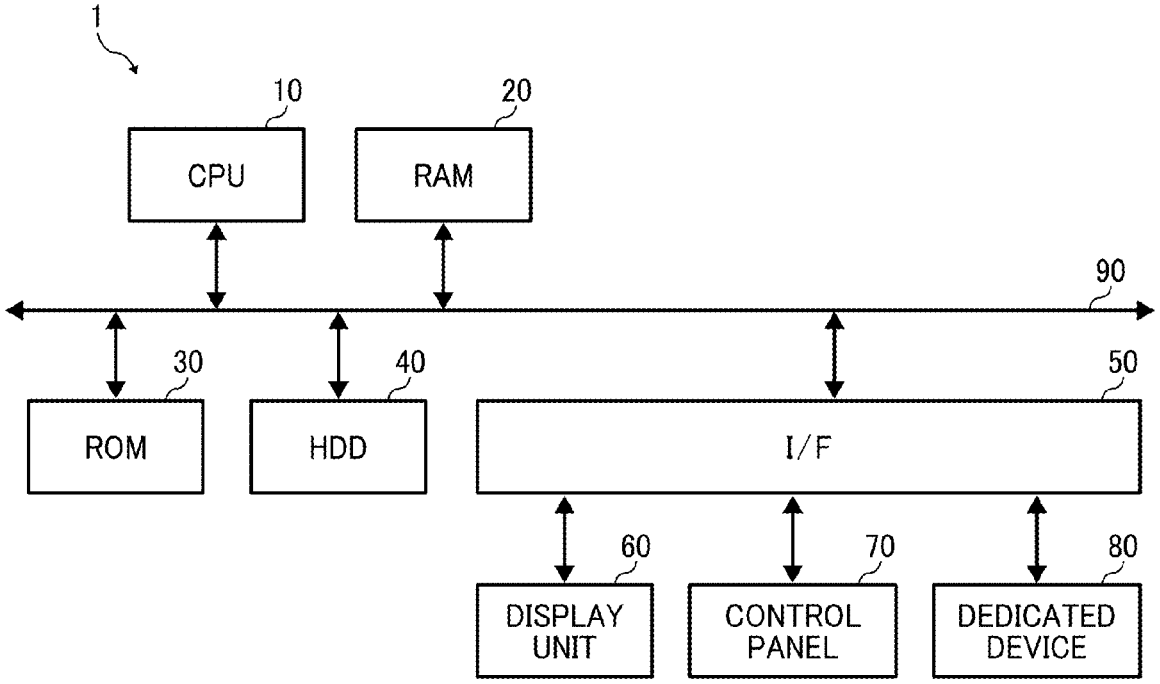
FIG. 1 is a schematic block diagram of a hardware configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

As described above, after a toner image is transferred from an image bearer onto either an intermediate transfer medium or a sheet of recording media, a certain amount of developer such as toner remains on the image bearer and collected by a cleaning device. In the embodiments described below, switching between disposal and reuse of developer collected from the image bearer is performed properly in an image forming apparatus.

In particular, whether collected developer is disposed or reused is determined based on comparison between a count A (i.e., required waste amount) and a count B (i.e., accumulative waste amount), which are statistics calculated or measured based on statistical data such as a total amount of toner transferred or disposed in a predetermined period. Accordingly, both of advantages attained by reuse of developer, such as reductions of environmental impact, running cost of the apparatus, and complexity of maintenance and management, and image quality guarantee, are attained.

Referring now to the drawings, wherein like reference numerals designate identical or corresponding parts throughout the several views thereof, a multicolor image forming apparatus according to an embodiment of the present invention is described.

First Embodiment

Initially, descriptions are given below of a hardware configuration of an image forming apparatus 1 according to the present embodiment with reference to FIG. 1.

FIG. 1 is a schematic block diagram of the hardware configuration of the image forming apparatus 1. It is to be noted that, in addition to the hardware configuration shown in FIG. 1, the image forming apparatus 1 includes an engine to realize capabilities of printing, scanning, facsimile transmission, and facsimile reception.

As shown in FIG. 1, the image forming apparatus 1 according to the present embodiment has a configuration similar to that of typical servers and computers. That is, the image forming apparatus 1 includes a central processing unit (CPU) 10, a random access memory (RAM) 20, a read only memory (ROM) 30, a hard disk drive (HDD) 40, and an interface (I/F) 50, which are connected to each other via a bus 90. To the interface 50, further a display unit 60, a control panel 70, and dedicated devices 80 are connected.

The CPU 10 is a computation device and controls actions of the entire image forming apparatus 1. The RAM 20 is a volatile memory capable of high-speed data reading and writing. The RAM 20 is used as workspace when the CPU 10 processes data. The ROM 30 is a non-volatile memory dedicated to reading out and stores programs such as firmware. The HDD 40 is a non-volatile memory capable of data reading and writing, and an operating system (OS), various types of control programs, application programs, and the like are stored therein.

The interface 50 connects the bus 90 to the various types of hardware and networks and controls the bus 90, the hardware, and the networks. The display unit 60 is a visual user interface for users to check a status of the image forming apparatus 1 and is realized by a display such as a liquid crystal display (LCD). The control panel 70 is a user interface for users to input data to the image forming apparatus 1 and includes a keyboard, a mouse, and the like. The dedicated devices 80 are hardware to realize dedicated capabilities of printing, scanning, fax transmission, and fax reception.

In the above-described hardware configuration, the CPU 10 executes computation according to programs loaded in the RAM 20 from the ROM 30, the HDD 40, or recording media such as optical disk. Then, control software is implemented. With the implement control software and the above-described hardware configuration, a function block for the capabilities of the image forming apparatus 1 is configured.

Figure 2:
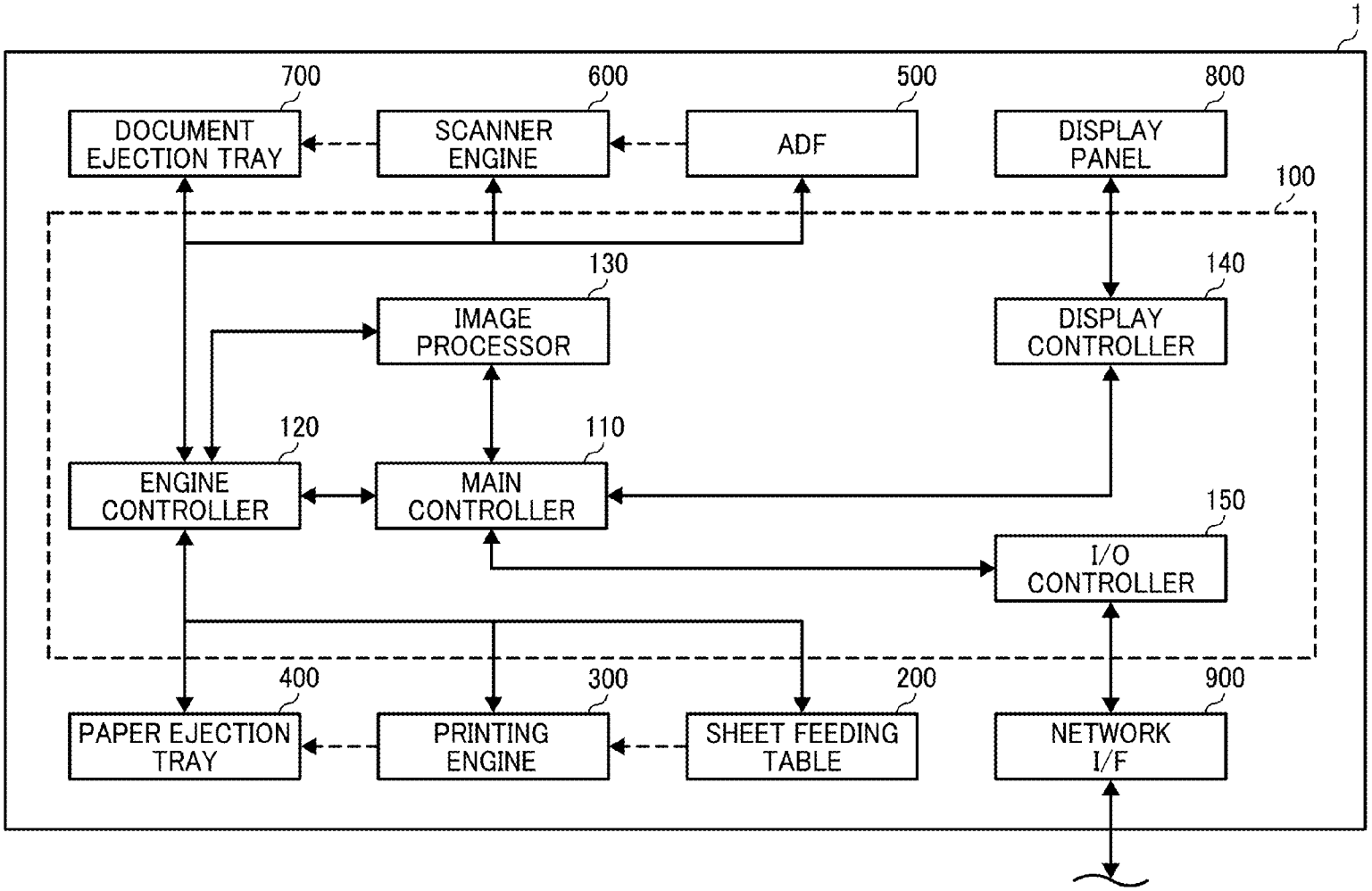
FIG. 2 is a schematic block diagram of a functional configuration of an image forming apparatus according to an embodiment.

Next, descriptions are given below of a functional configuration of the image forming apparatus 1 according to the present embodiment with reference to FIG. 2. FIG. 2 is a schematic block diagram of the functional configuration of the image forming apparatus 1. It is to be noted that, in FIG. 2, solid lines represent electrical connections, and broken lines represent flow of recording sheets or documents.

In the configuration shown in FIG. 2, the image forming apparatus 1 includes a controller 100, a sheet feeding table 200, a printing engine 300, a paper ejection tray 400, an automatic document feeder (ADF) 500, a scanner engine 600, a document ejection tray 700, a display panel 800, and a network interface (I/F) 900. The controller 100 includes a main controller 110, an engine controller 120, an image processor 130, a display controller 140, and an input/output (I/O) controller 150.

The sheet feeding table 200 feeds sheets 2 of recording media (i.e., transfer sheets) to the printing engine 300 serving as an image forming unit. The printing engine 300 outputs images on the sheets 2 transported from the sheet feeding table 200. In the present embodiment, the printing engine 300 is an electrophotographic image forming unit. After the printing engine 300 forms an image thereon, the sheet 2 is ejected to the paper ejection tray 400. The printing engine 300 is implemented by the dedicated device 80 shown in FIG. 1.

The ADF 500 automatically transports documents to the scanner engine 600 serving as a document reading device. The scanner engine 600 is a document reading device that includes a photoelectric conversion element to convert optical data into electric signals. The scanner engine 600 optically scans the document transported by the ADF 500 or set on an exposure glass (i.e., a document table) and generates image data. The document is ejected to the document ejection tray 700 after being read by the scanner engine 600. The ADF 500 and the scanner engine 600 are implemented by the dedicated device 80 shown in FIG. 1.

The display panel 800 serves as both of an output interface to visually display the state of the image forming apparatus 1 and an input interface such as a touch panel for users to directly operate the image forming apparatus 1 or input data into the image forming apparatus 1. That is, the display panel 800 is capable of displaying images to be operated by the users. The display panel 800 is implemented by the display unit 60 and the control panel 70 shown in FIG. 1.

The network interface 900 is an interface for the image forming apparatus 1 to communicate with other devices such as administrator terminals and computers. Examples usable as the network interface 900 include Ethernet®, USB (Universal Serial Bus) interface, Bluetooth®, Wi-Fi® (Wireless Fidelity), and FeliCa®. The image forming apparatus 1 according to the present embodiment thus receives image data and commands such as print request from the terminals connected thereto via the network interface 900. The network interface 900 is implemented by the interface 90 shown in FIG. 1.

The controller 100 is configured by a combination of software and hardware. Specifically, the controller 100 is constructed with hardware such as integrated circuits and the control software implemented by the CPU 10 performing the control programs such as firmware loaded from the non-volatile memories, such as the ROM 30 and the HDD 40, to the RAM 20. The controller 100 controls the image forming apparatus 1 entirely.

The main controller 110 controls, that is, gives commands to, respective units of the controller 100. The main controller 110 controls the I/O controller 150 and accesses other devices via the network interface 900 and networks. The engine controller 120 controls or drives driving units such as the printing engine 300, the scanner engine 600, and the like.

The image processor 130 is governed by the main controller 110 and generates drawing data, as output data, according to image data written by PDL (Page Description Language) such as document data or image data included in input print jobs. For example, the drawing data include bitmap data of cyan (C), magenta (M), yellow (Y), and black (B), according to which the printing engine 300 draws images in image formation.

Additionally, the image processor 130 processes captured images input from the scanner engine 600 and generates image data. The image data is stored as scanning results in the image forming apparatus 1 or transmitted via the network interface 900 or networks to other devices. It is to be noted that, in the present embodiment, instead of image data, drawing data may be directly input to the image forming apparatus 1 so that the image forming apparatus 1 outputs images according to the drawing data.

The display controller 140 displays data on the display panel 800 or reports the input data to the main controller 110 via the display panel 800. The I/O controller 150 inputs signals and commands received via the network interface 900 and networks to the main controller 110.

Next, descriptions are given below of the printing engine 300 according to the present embodiment with reference to FIG. 3.

Figure 3:
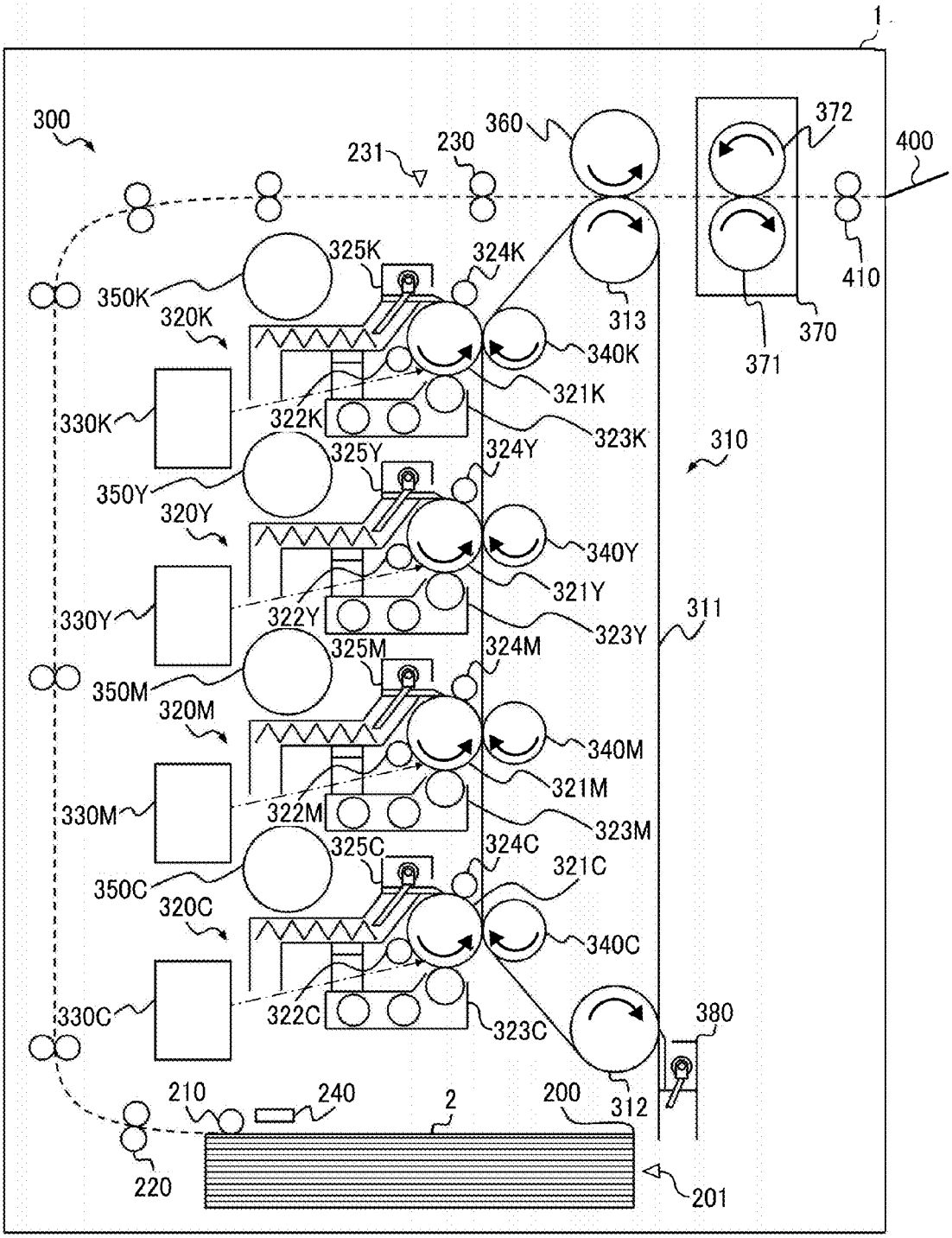
FIG. 3 is a schematic entire view of an image forming apparatus according to an embodiment.

FIG. 3 is a schematic entire view of the image forming apparatus 1 according to the present embodiment. In the configuration shown in FIG. 3, the printing engine 300 forms an image on the sheet 2 fed from the sheet feeding table 200, and then the sheet 2 is ejected to the paper ejection tray 400.

Additionally, in the configuration shown in FIG. 3, the printing engine 300 includes image forming units 320 (320C, 320M, 320Y, and 320K) for respective colors, arranged along an endless conveyor 310, which is a configuration generally called "tandem type". Specifically, in the printing engine 300, along a conveyance belt 311 looped around a driving roller 312 and a driven roller 313, the image forming units 320C, 320M, 320Y, and 320K are arranged in that order in a direction in which the conveyance belt 311 transports the sheet 2.

The image forming units 320C, 320M, 320Y, and 320K form cyan, magenta, yellow, and black images, respectively. The multiple image forming units 320C, 320M, 320Y, and 320K are different in the color of toner used therein, but interior structures thereof are similar. Accordingly, only the image forming unit 320C is described in detail below, and descriptions of components of the image forming units 320M, 320C, and 320K, given subscripts "M", "C", and "K" instead of "C" in the drawings, are omitted. Further, the suffixes Y, M, C, and K may be omitted when color discrimination is not necessary.

The conveyance belt 311 looped around the driving roller 312 and the driven roller 313 is an intermediate transfer belt, and the image forming units 320C, 320M, 320Y, and 320K respectively form intermediate transfer images on the conveyance belt 311. A driving motor rotates the driving roller 312. The driving motor, the driving roller 312, and the driven roller 313 together rotate the conveyance belt 311.

The image forming unit 320C includes a photoconductor drum 321C and components disposed therearound, namely, a charging device 322C, a developing device 323C, a discharger 324C, and a toner collecting device 325C.

The image forming unit 320C forms cyan images on the conveyance belt 311 as follows. In the image forming unit 320C, the charging device 322C charges uniformly the outer circumferential face of the photoconductor drum 321C in the dark, after which an optical writing device 330C directs light corresponding to cyan images to the photoconductor drum 321C, thus forming an electrostatic latent image thereon. The developing device 320C develops the electrostatic latent image with cyan toner into a visible image (i.e., cyan toner image) on the photoconductor drum 321C. In other words, the developing device 323 serves as a developer image forming device.

At a primary-transfer position where the photoconductor drum 321C contacts or is closest to the conveyance belt 311, a transfer roller 340C is pressed by a biasing member to the photoconductor drum 321C, thereby transferring the toner image onto the conveyance belt 311. Thus, the cyan toner image (i.e., a cyan intermediate image) is formed on the conveyance belt 311. Specifically, a transfer bias is applied to the transfer roller 340C. With the transfer bias, a transfer electrical field is generated at the primary-transfer position between the photoconductor drum 321C and the transfer roller 340C, and the toner image is transferred from the photoreceptor drum 321C onto the conveyance belt 311.

After the cyan intermediate image is transferred onto the conveyance belt 311, the toner collecting device 325C collects toner remaining on the outer circumferential face of the photoconductor drum 321C, after which the discharger 324C discharges the outer circumferential face of the photoconductor drum 321C. Then, a preparation for subsequent image formation, such as supply of toner to the developing device 323C from a toner supply assembly 350C including a toner bottle and a toner supply device is executed, and the image forming unit 320C goes standby. The toner collecting device 325 includes a partition shutter 325*j* serving as a channel switching member to switch a conveyance route of toner collected from the photoconductor drum 321 between disposal and reuse. The toner collecting device 325C is described in further detail later with reference to FIGS. 7 and 8.

The cyan toner image on the conveyance belt 311 is then transported to the image forming unit 320M as the conveyance belt 311 is rotated by the driving roller 312 and the driven roller 313. The image forming unit 320M forms a magenta image on the photoconductor drum 321M through image forming processes similar to those executed by the image forming unit 320C, and the magenta toner image is superimposed on the cyan toner image on the conveyance belt 311. Thus, a bicolor intermediate image of cyan and magenta is formed on the conveyance belt 311.

The bicolor intermediate image on the conveyance belt 311 is transported sequentially to the image forming units 320Y and 320K, where yellow and black toner images are respectively transferred from the photoconductor drums 321Y and 321K and superimposed on the intermediate image on the conveyance belt 311. Thus, a full-color intermediate image is formed on the conveyance belt 311.

Meanwhile, the sheets 2 stored in the sheet feeding table 200 are sequentially separated and transported from the top by a sheet feeding roller 210 and a pair of separation rollers 220 to a pair of registration rollers 230. After correcting skew of the sheet 2, the registration rollers 230 transport the sheet 2 to a secondary-transfer position, timed to coincide with the conveyance of the conveyance belt 311. At the secondary-transfer position, the sheet 2 contacts or approaches most of the conveyance belt 311 on the route through which the sheet 2 is transported.

At the secondary-transfer position, a transfer roller 360 is pressed to the driven roller 313 by a biasing member, thereby transferring the toner image from the conveyance belt 311 onto the sheet 2. The sheet 2 is further transported to a fixing device 370, where the toner image is fixed on the sheet 2 while the sheet 2 is pressed and heated in the direction perpendicular to the surface of the sheet bearing the toner image (i.e., an image formation surface). Then, a pair of paper ejection rollers 410 eject the sheet 2 to the paper ejection tray 400.

Specifically, the fixing device 370 in the present embodiment includes fixing rollers 371 and 372 that rotate while clamping the sheet 2, thereby transporting and pressing the sheet 2. A heating element is provided on a fixing face of the fixing roller 371 to heat the sheet 2. Thus, in the fixing device 370, the fixing rollers 371 and 372 fix the image on the sheet 2 by heating and clamping the sheet 2 in the direction perpendicular to the image formation surface.

A belt cleaner 380 includes a cleaning blade pressed to the conveyance belt 311 at a position downstream from the secondary-transfer position and upstream from the image forming unit 320C in the conveyance direction of the conveyance belt 311. The cleaning blade scrapes off toner adhering to the conveyance belt 311, and thus the conveyance belt 311 is cleaned.

Thus, the printing engine 300 in the present embodiment includes the endless conveyor 310, the image forming units 320, the optical writing device 330, the transfer rollers 340 and 360, the toner supply assembly 350, the fixing device 370, and the belt cleaner 380. The printing engine 300 further includes an internal controller 390 (shown in FIG. 10) to control or drive the respective parts of the printing engine 300. A functional configuration of the internal controller 390 is described later with reference to FIG. 10.

In FIG. 3, reference numerals 201 represents an environment sensor to detect humidity, temperature, or both, and 231 represents a sensor to detect smear of the registration rollers 230.

Further, in the configuration shown in FIG. 3, a smoothness sensor 240 is disposed above the sheet feeding table 200. According to a detection signal generated by the smoothness sensor 240, the image forming apparatus 1 according to the present embodiment measures the smoothness of the sheet 2 stored in the sheet feeding table 200.

The smoothness sensor 240 is described in further detail below.

Figure 5:
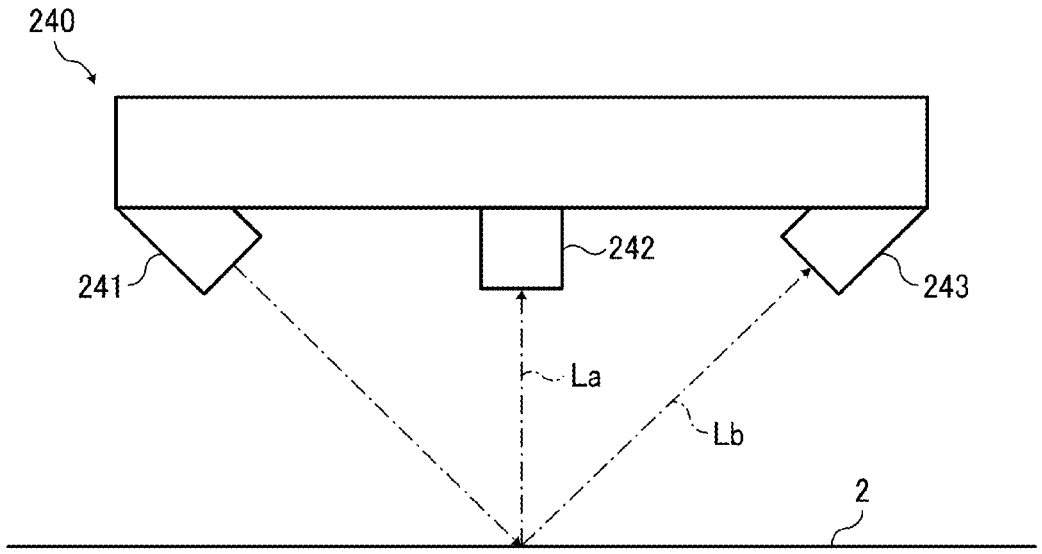
FIG. 5 is a schematic view of a smoothness sensor according to an embodiment.

FIG. 5 is a schematic view of the smoothness sensor 240 according to the present embodiment.

In the configuration shown in FIG. 5, the smoothness sensor 240 includes a light source 241 and first and second light-receiving portions 242 and 243. The light source 241 emits lights to the sheet 2. The first light-receiving portion 242 receives diffuse reflection light La, meaning the light reflected in the direction perpendicular to the image formation surface of the sheet 2, out of light reflected on the sheet 2 irradiated by the light source 241. The first light-receiving portion 242 then outputs a detection signal corresponding to the amount of light received. The second light-receiving portion 243 receives specular reflection light Lb, meaning the light reflected in such a manner that the incident angle is equal to the angle of reflection relative to the direction perpendicular to the image formation surface of the sheet 2, out of light reflected on the sheet 2 irradiated by the f light source 241. The second light-receiving portion 243 then outputs a detection signal corresponding to the amount of light received.

Figure 6:
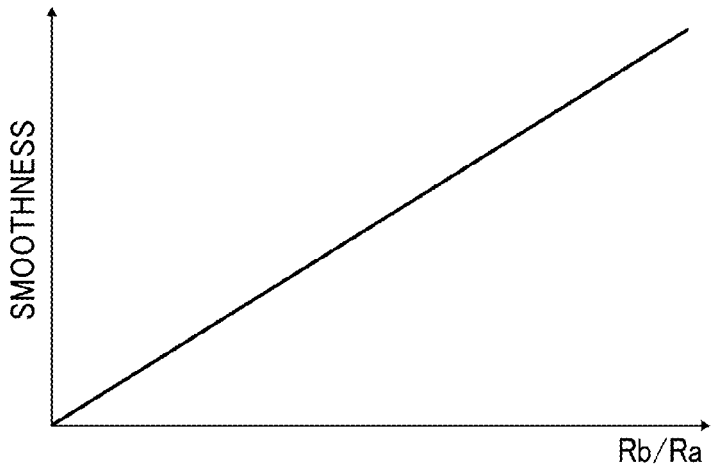
FIG. 6 is a graph of the relation between smoothness of a sheet and a ratio of a specular reflection light amount received by a first light-receiving portion to a diffuse reflection light amount received by a second light-receiving portion according to an embodiment.

FIG. 6 is a graph of the relation between the smoothness of the sheet 2 and the ratio of a specular reflection light amount Rb to a diffuse reflection light amount Ra (Rb/Ra).

Referring to FIG. 6, in the smoothness sensor 240 having such a configuration, as the smoothness of the image formation surface increases, the ratio of the specular reflection light amount Rb received by the second light-receiving portion 243 to the diffuse reflection light amount Ra received by the first light-receiving portion 242 (Rb/Ra) increases.

The image forming apparatus 1 according to the present embodiment measures the ratio Rb/Ra using the smoothness sensor 240 and accordingly detects the smoothness of the sheet 2 with a higher degree of accuracy.

Although the smoothness sensor 240 shown in FIG. 5 is described above, Bekk method for determination of smoothness is employed in another embodiment, and Oken method is employed in yet another embodiment.

Figure 4:
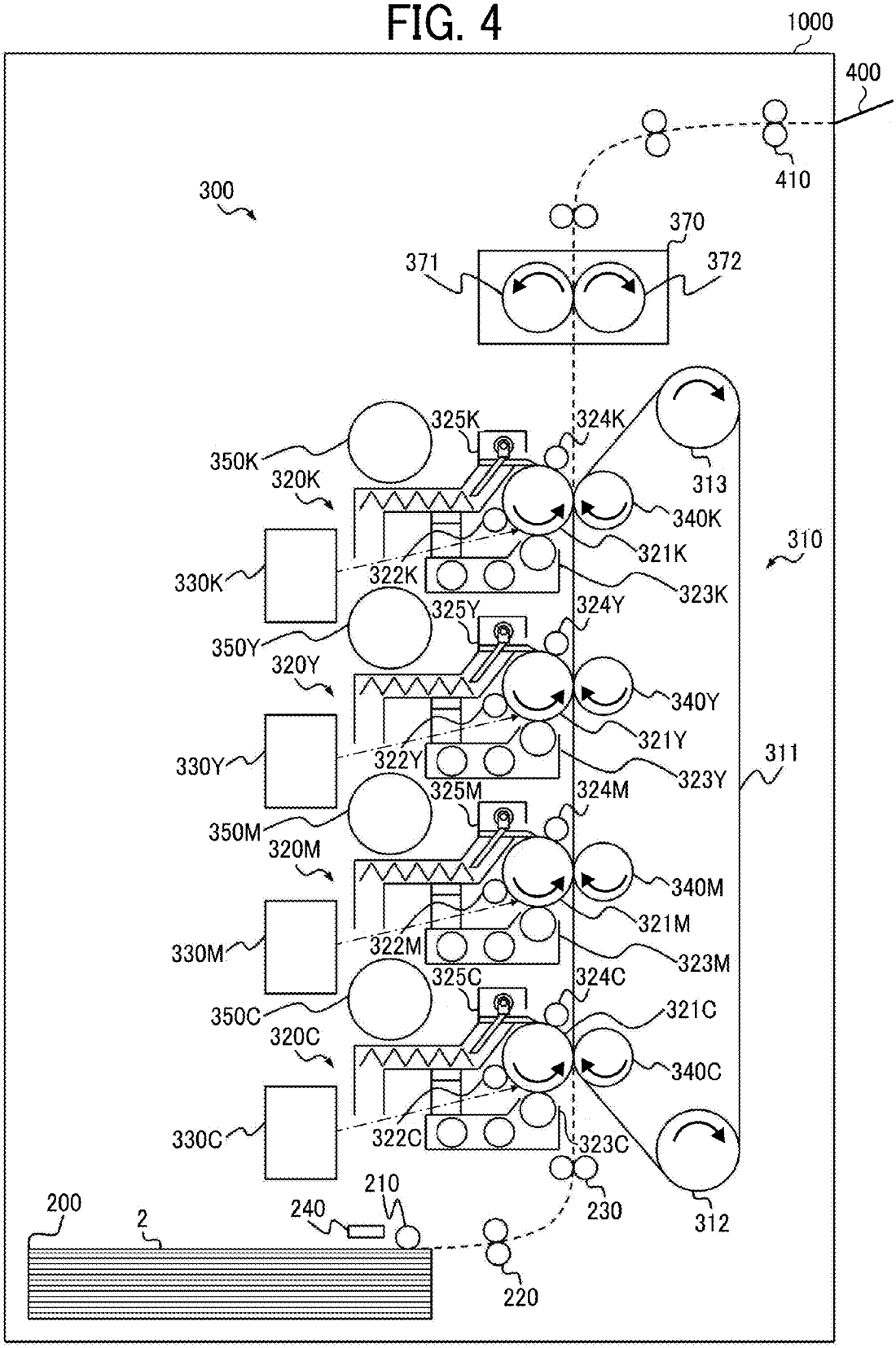
FIG. 4 is a schematic entire view of an image forming apparatus according to another embodiment.

It is to be noted that the description above concerns an intermediate transfer (indirect transfer) method, in which the toner image is transferred from the photoconductor drum 321 serving as image bearer onto the conveyance belt 311 serving as an intermediate transfer medium to transfer the image onto the sheet 2. Alternatively, an image forming apparatus according to another embodiment employs a direct transfer method as shown in FIG. 4.

Specifically, in an image forming apparatus 1000 shown in 4, the transfer roller 340 transfers the toner image from the photoconductor drum 321 directly onto the sheet 2 transported by the conveyance belt 311, and the transfer roller 360 and the belt cleaner 380 are not included.

Next, the toner collecting device 325 is described in further detail with reference to FIGS. 7 and 8.

Figure 7:
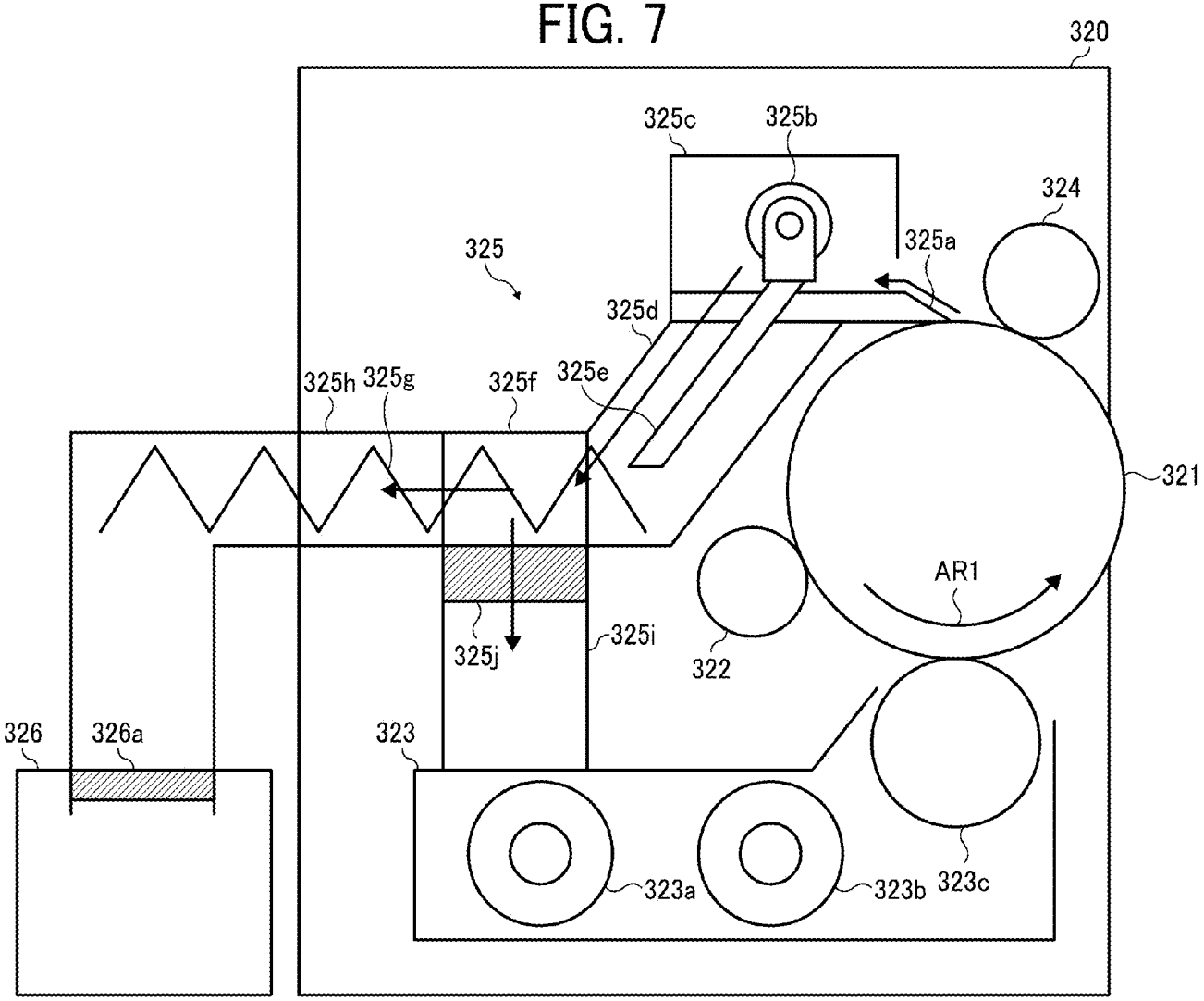
FIG. 7 is a cross-sectional view of an image forming unit according to an embodiment, being a posture installed in the image forming apparatus, as viewed in a main scanning direction.

FIG. 7 is a cross-sectional view of the image forming unit 320 as viewed in a main scanning direction when the image forming unit 320 is in the posture installed in image forming apparatus 1. FIG. 8 is a view of the image forming unit 320 being the posture installed in the image forming apparatus 1, as viewed obliquely from above. It is to be noted that the descriptions below mainly concerns the toner collecting device 325C with reference to FIGS. 7 and 8 since the image forming units 320 are described above with reference to FIG. 3.

Figure 8:
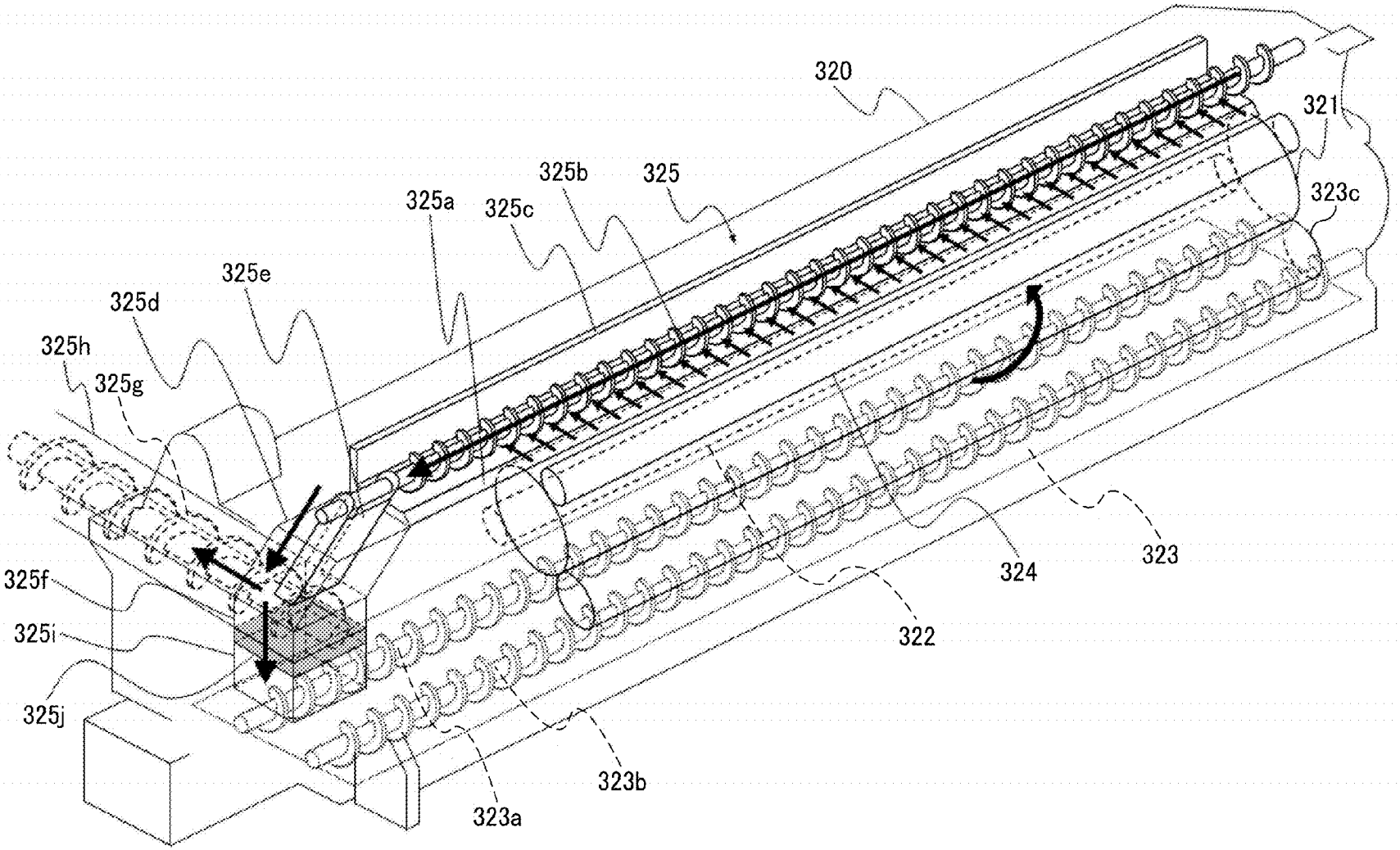
FIG. 8 is a view of the image forming unit being the posture installed in the image forming apparatus, as viewed obliquely from above.

In the configuration shown in FIGS. 7 and 8, the toner collecting device 325 includes a cleaning blade 325*a*, a collected-toner conveying screw 325*b*, collected-toner channels 325*c* and 325*d*, a guide channel 325*e*, a branch portion 325*f*, a screw 325*g*, a waste channel 325*h*, a reuse channel 325*i*, and the partition shutter 325*j*.

The cleaning blade 325*a* is pressed against the outer circumferential face of the photoconductor drum 321, thereby scraping off toner from the photoconductor drum 321 and collecting the toner (hereinafter "collected toner") in the collected-toner channel 325*c*.

The collected-toner conveying screw 325*b* transports the collected toner in the collected-toner channel 325*c* to the collected-toner channel 325*d*. Thus, the collected-toner conveying screw 325*b* serves as a collected-developer conveying member. The collected toner transported by the collected-toner conveying screw 325*b* from the collected-toner channel 325*c* to the collected-toner channel 325*d* is guided by the guide channel 325*e* to the branch portion 325*f*. At the branch portion 325*f*, the collected-toner channel 325*d* branches into the waste channel 325*h* and the reuse channel 325*i*.

The screw 325*g* transports the collected toner through the waste channel 325*h* to a waste-toner container 326 to store waste toner. The collected toner to be disposed is transported through the waste channel 325*h* leading to the waste-toner container 326. The collected toner to be reused is transported through the conveying channel 325*i* leading to the developing device 323.

The partition shutter 325*j* is an openable and closable shutter and disposed in the branch portion 325*f* to partition the waste channel 325*h* from the reuse channel 325*i*. A driver such as a solenoid moves the partition shutter between an open position and a close position. The partition shutter 325*j* is closed when the toner collected from the photoconductor drum 321 is disposed without reusing the toner and opened when the toner is reused.

In the toner collecting device 325, toner is scraped off from the photoconductor drum 321 by the cleaning blade 325*a* pressed to the photoconductor drum 321 that is rotating in the direction indicated by arrow AR1 shown in FIG. 7, and the toner thus scraped off is collected in the collected-toner channel 325*c*.

Then, the toner is transported by the collected-toner conveying screw 325*b* through the collected-toner channel 325*c* to the collected-toner channel 325*d*, where the guide channel 325*e* guides the toner along the collected-toner channel 325*d* to the branch portion 325*f*.

When the collected toner is not to be reused, the partition shutter 325*j* is closed before the collected toner is transported to the branch portion 325*f*. The toner is then transported by the screw 325*g* through the waste channel 325*h* and stored in the waste-toner container 326 as waste toner.

By contrast, to reuse the collected toner (i.e., reused toner), the partition shutter 325*j* is opened before the toner is transported to the branch portion 325*f*. The toner then flows down under the gravity through the reuse channel 325*i* to the developing device 323.

Thus, the toner collecting device 325 includes the channel switching member, which in the present embodiment is the partition shutter 325*j* and a member to open and close the partition shutter 325*j*.

Figure 9:
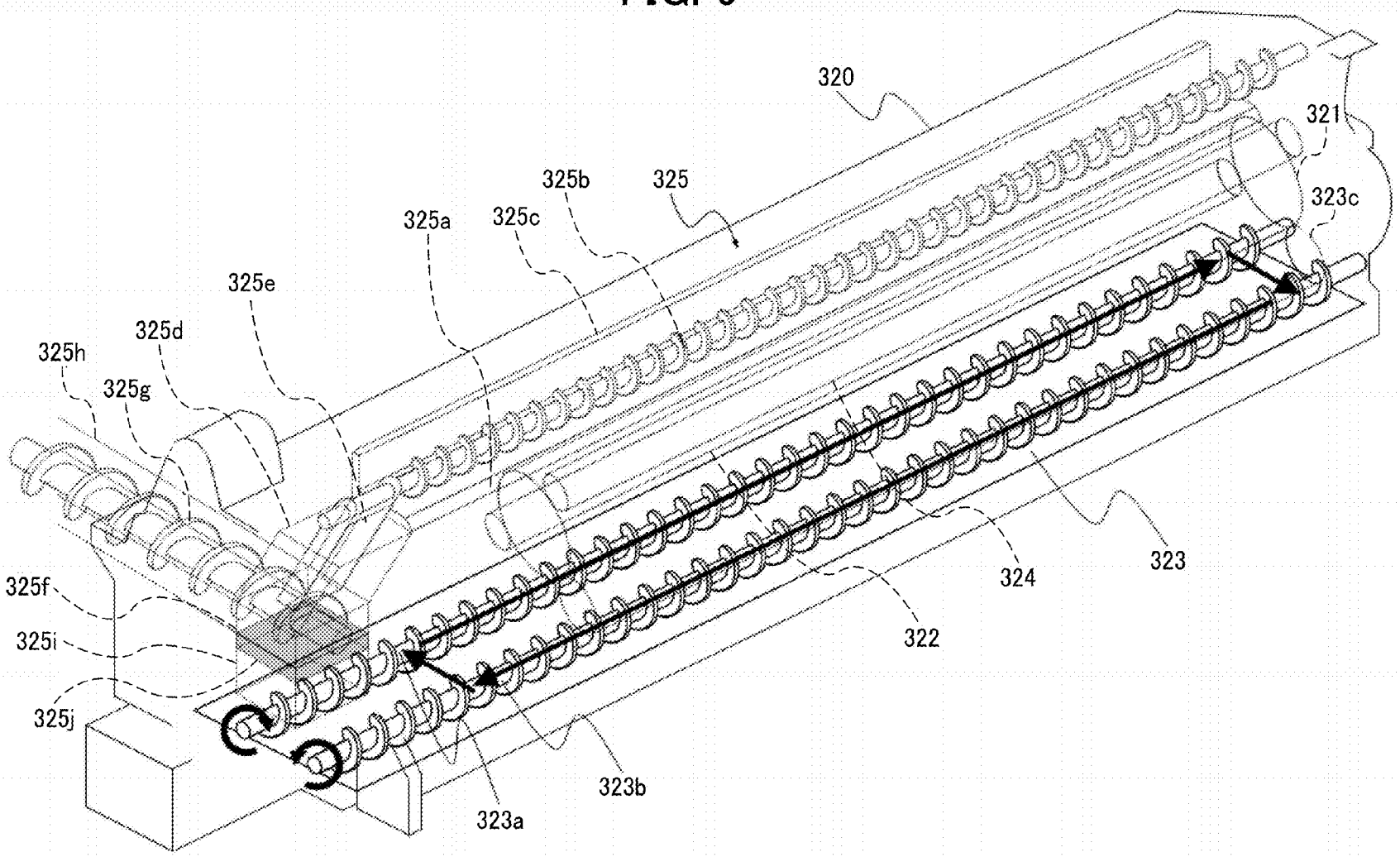
FIG. 9 is another view of the image forming unit being the posture installed in the image forming apparatus, as viewed obliquely from above.

Referring to FIG. 9, the developing device 323 includes developer conveying screws 323*a* and 323*b*, serving as developer conveying members, and a developing roller 323*c* serving as a developer bearer. Examples of the developer conveying members include screws, coils, augers, and paddles. The developer conveying screws 323*a* and 323*b* rotate in the opposite directions, thereby distributing the reused toner entirely in the main scanning direction together with the developer stored in the developing device 323. In image formation, the toner transported by the developer conveying screws 323*a* and 323*b* is supplied by the developing roller 323*c* to the outer circumferential face of the photoconductor drum 321. Thus, the collected toner is reused.

Additionally, the waste-toner container 326 includes a toner sensor 326*a* to detect waste toner. In the configuration shown in FIG. 7, the toner sensor 326*a* is secured at a connection between the waste-toner container 326 and the waste channel 325*h*. In present embodiment, according to detection signal output from the toner sensor 326*a*, the amount of waste toner in the waste-toner container 326 is measured with a high degree of accuracy. Accordingly, the image forming apparatus 1 according to the present embodiment estimates an accumulative amount of waste toner, which serves as a count B described later.

Next, descriptions are given below of a functional configuration of the internal controller 390 according to the present embodiment.

Figure 10:
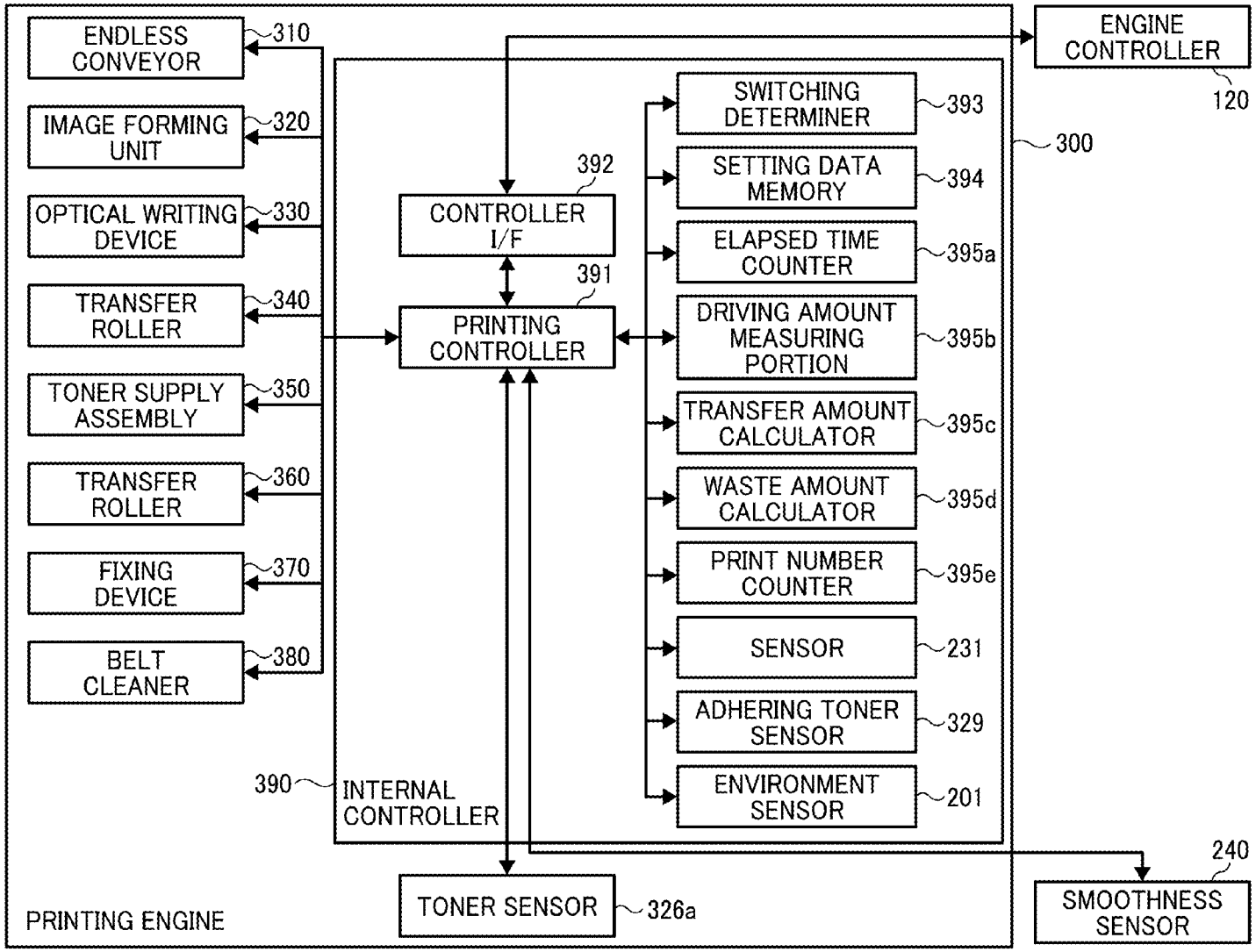
FIG. 10 is a schematic block diagram of a functional configuration of a printing engine according to an embodiment.

FIG. 10 is a schematic block diagram of a functional configuration of the printing engine 300.

As shown in FIG. 10, the internal controller 390 according to the present embodiment includes a printing controller 391, a controller interface (I/F) 392, the switching determiner 393, a setting data memory 394, an elapsed time counter 395*a*, a driving amount measuring portion 395*b*, a transfer amount calculator 395*c*, a waste amount calculator 395*d*, and a print number counter 395*c*.

The printing controller 391 controls respective portions of the internal controller 390 and gives commands thereto. Additionally, the printing controller 391 controls or drives the respective portions of the printing engine 300 according to data input from the engine controller 120 via the controller interface 392. Thus, the printing engine 300 acquires data to control or drive the respective portions thereof from the engine controller 120 via the controller interface 392.

The controller interface 392 is an interface for the internal controller 390 to communicate with the engine controller 120.

The switching determiner 393 calculates, measures, or acquires the counts A and B and determines whether collected toner is disposed or reused based on the comparison (i.e., relation of magnitude) between the counts A and B. According to the determination made by the switching determiner 393, the printing controller 391 switches the partition shutter 325*j* between the open position and the close position. Thus, the printing controller 391 serves as a switching controller in the present embodiment. The counts A and B, described in detail later, are statistics either calculated or measured based on statistical data such as the total amount of toner transferred or disposed in the predetermined period.

An aspect of the present embodiment is determination (hereinafter "switching determination") by the switching determiner 393 to control the switching of conveyance route of collected developer between the waste channel 325*h* and the reuse channel 325*i* in the toner collecting device 325, which is described in detail later with reference to FIG. 12.

In other words, an aspect of the present embodiment is to determine whether collected toner is disposed or reused based on comparison between the count A and count B. Accordingly, the image forming apparatus 1 according to the present embodiment attains both of advantages attained by reuse of developer, such as reductions of environmental impact, running cost of the apparatus, and complexity of maintenance and management, and image quality guarantee.

The setting data memory 394 stores an ideal transfer pace described later.

The elapsed time counter 395*a* measures the elapsed time from start to end of a target period described below. As described above, the switching determiner 393 determines whether collected toner is disposed or reused based on comparison between the count A (i.e., required waste amount) and the count B (i.e., accumulative waste amount) either calculated or measured based on the statistical data (such as the total amount of toner transferred or disposed). The target period means the predetermined period during which the statistical data is accumulated.

There are multiple methods to determine the target period. Example methods are described below with reference to FIGS. 11A and 11B, but the target period may be determined through a method different from those shown in FIGS. 11A and 11B.

Figure 11A:
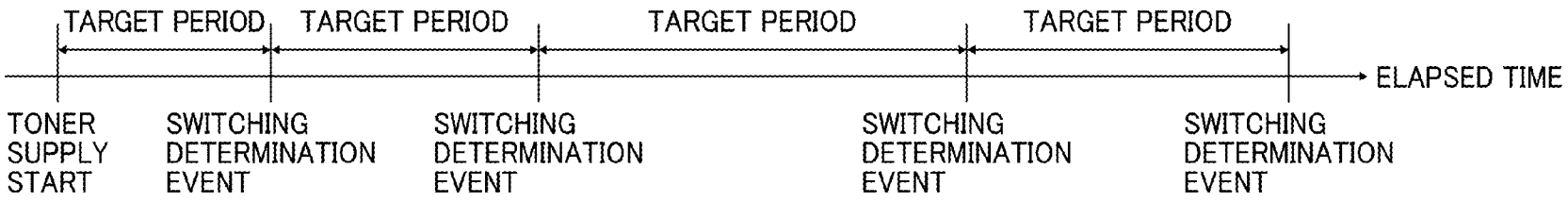
FIGS. 11A and 11B are example timing charts of determination of a target period for switching determination according to an embodiment.
Figure 11B:
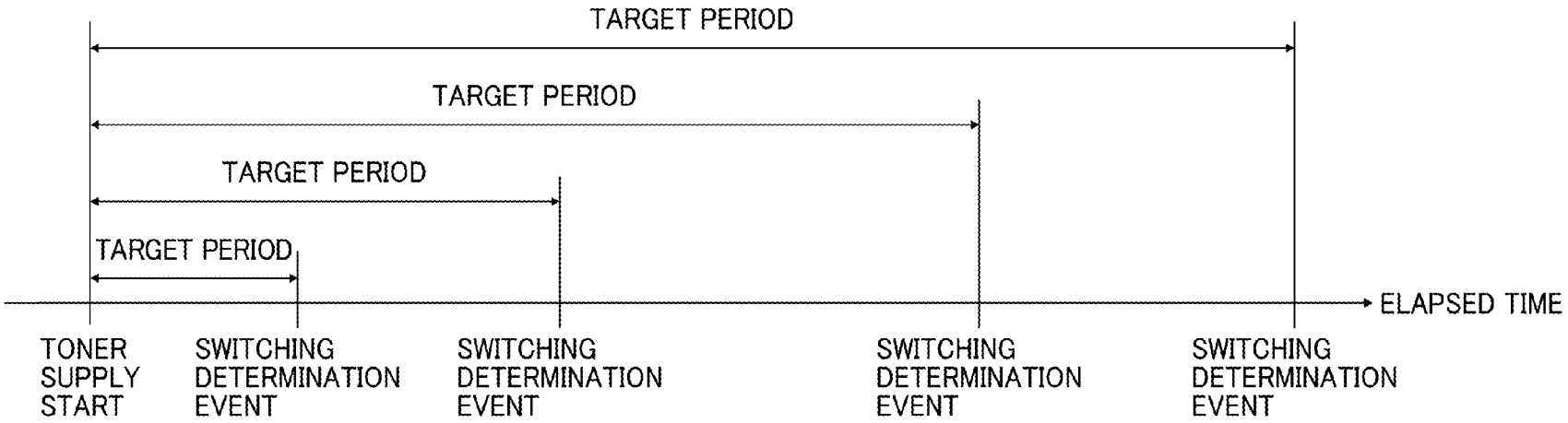

FIGS. 11A and 11B are timing charts of determination of the target period for the switching determination made by the switching determiner 393.

Referring to FIG. 11A, when an switching determination event for the image forming apparatus 1 to perform switching determination occurs, the switching determiner 393 regards a period from the occurrence of a previous switching determination event to the occurrence of a current switching determination event as the target period. It is to be noted that, as shown in FIG. 11A, if no switching determination events occur previously, the target period is a period from the start of toner supply from the toner supply assembly 350 to the developing device 323 to the occurrence of the current switching determination event.

It is to be noted that, for example, the switching determination event occurs when the number of sheets output reaches a threshold, or the driving amount of the photoconductor drum 321 or the developing roller 323*c* reaches a threshold.

In another embodiment, as shown in FIG. 11B, the switching determiner 393 regards, as the target period, the period from the start of toner supply from the toner supply assembly 350 to the developing device 323 to the occurrence of the current switching determination event.

Determination of target period is described below using the case shown in FIG. 11A, in which the switching determiner 393 regards, as the target period, the period from the occurrence of the previous switching determination event to the occurrence of the current switching determination event.

The driving amount measuring portion 395*b* measures the driving amount of the developer conveying screws 323*a* and 323*b* to transport developer inside the developing device 323 in the main scanning direction. Specifically, the driving amount means the number of revolutions, rotation distance, driving time, or the like of the developer conveying screws 323*a* and 323*b* during the target period.

The transfer amount calculator 395*c* calculates the amount in total of toner transferred (hereinafter "accumulative transfer amount") in image formation during the target period. In the present embodiment, the transfer amount calculator 395*c* serves as a transfer amount estimator. It is to be noted that the image forming apparatus 1 according to the present embodiment does not actually measure the amount of transferred toner and accordingly does not actually measure the accumulative transfer amount. The transfer amount calculator 395*c* in the present embodiment calculates the amount of toner transferred in each image formation based on the pixel data included in the output data, obtained from the engine controller 120 via the controller interface 392, and efficiency in transferring toner from the photoconductor drum 321 onto transfer sheets. Additionally, the transfer amount calculator 395*c* adds the calculated amount of transferred toner to the total amount summed up since the previous calculation. The transfer amount calculator 395*c* repeats this operation for the entire duration of the target period, thereby detecting the above-described accumulative transfer amount.

The waste amount calculator 395*d* calculates the amount in total of toner (hereinafter "accumulative waste amount") disposed in the waste-toner container 326 during the target period. In the present embodiment, the waste amount calculator 395*d* serves as an accumulative waste amount estimator. The waste amount calculator 395*d* detects the amount of toner disposed in the waste-toner container 326 based on detection signals output from the toner sensor 326*a* each time toner is disposed and adds the detected amount to the total amount summed up since the previous calculation. The waste amount calculator 395*d* repeats this operation for the entire duration of the target period, thereby detecting the accumulative waste amount. The print number counter 395*e* counts the number of sheets printed during the target period.

Next, descriptions are given below of switching between disposal and reuse of collected toner in the toner collecting device 325 with reference to FIG. 12.

Figure 12:
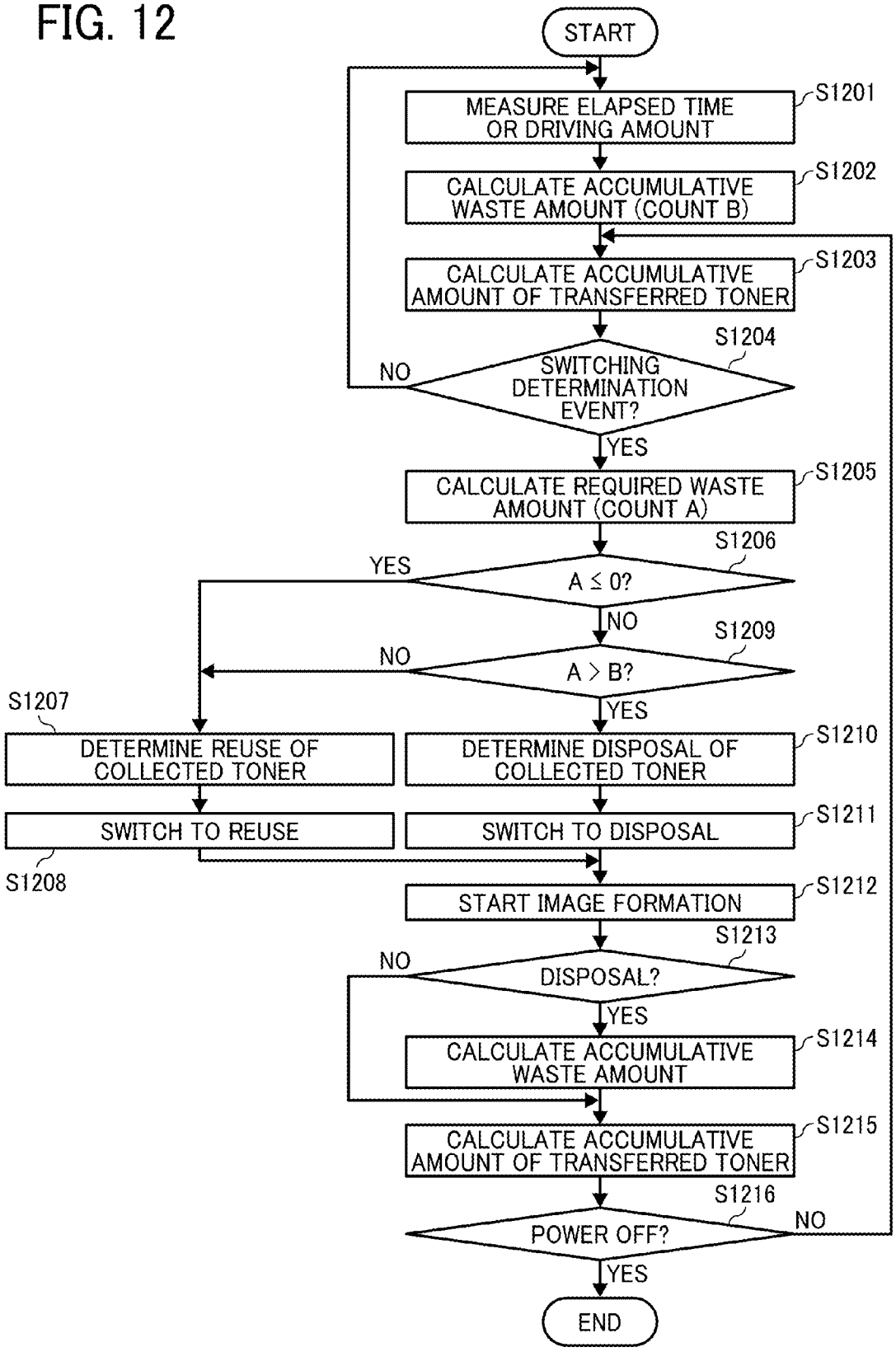
FIG. 12 is a flowchart of processing for switching between disposal and reuse of collected toner according to an embodiment.

FIG. 12 is a flowchart of processing for switching between disposal and reuse in the toner collecting device 325 according to the present embodiment.

Referring to FIG. 12, at S1201, the elapsed time counter 395*a* counts the elapsed time, or the driving amount measuring portion 395*b* measures the driving amount of the developer conveying screws 323*a* and 323*b*, while no switching determination event occurs (No at S1204). At S1202, the waste amount calculator 395*d* calculates the accumulative waste amount as the count B. At S1203, the transfer amount calculator 395*c* calculates the accumulative transfer amount.

When a switching determination event occurs (Yes at S1204), at S1205, the switching determiner 393 calculates the amount in total of toner to be disposed (hereinafter "required waste amount") within the target period based on the ideal transfer pace stored in the setting data memory 394, the elapsed time counted or the driving amount measured at S1201, and the accumulative transfer amount calculated at S1203. Thus, in the present embodiment, the switching determiner 393 serves as a waste amount determiner. The required waste amount is described in detail later.

At S1206, the switching determiner 393 regards the required waste amount calculated at S1205 as the count A and judges whether or not the count A is greater than zero (A≤0).

When the count A is not greater than zero (A≤0, Yes at S1206), the switching determiner 393 determines that the toner collected from the photoconductor drum 321 is to be reused at S1207.

A reason for the determination of the switching determiner 393 when the count A is not greater than zero (A≤0) is described in detail later.

According to the determination made by the switching determiner 393, the printing controller 391 switches the conveyance route of collected toner in the toner collecting device 325 to the reuse channel 325*i* to reuse the collected toner. That is, the printing controller 391 controls the toner collecting device 325 to open the partition shutter 325*j* in the toner collecting device 325.

By contrast, when the count A is greater than zero (A>0, No at S1206), at S1209, the switching determiner 393 compares the count A (required waste amount) with the count B (accumulative waste amount) measured at S1202. In FIG. 12, the switching determiner 393 judges whether the count A is greater than the count B.

When the count A is greater than zero (A>B, Yes at S1209), at S1210, the switching determiner 393 determines to dispose the toner collected from the photoconductor drum 321 without reusing it.

According to the determination made by the switching determiner 393, at S1211, the printing controller 391 switches, in the toner collecting device 325, the conveyance route of collected toner to the waste channel 325*h*. That is, the printing controller 391 controls the toner collecting device 325 to close the partition shutter 325*j*.

By contrast, when the count A is not greater than zero (A≤B, No at S1209), at S1207, the switching determiner 393 determines to reuse the collected toner.

At S1208, according to the determination made by the switching determiner 393, the printing controller 391 switches, in the toner collecting device 325, the conveyance route of collected toner to the reuse channel 325*i*. That is, the printing controller 391 controls the toner collecting device 325 to open the partition shutter 325*j*.

Due to a reason described later, the switching determiner 393 can decide reuse or disposal of collected toner based on the comparison result between the counts A and B when the count A is greater than zero (A>0, No at S1206).

At S1212, image formation is started. At that time, when the partition shutter 325*j* is at the close position to dispose collected toner (Yes at S1213), the collected toner (i.e., waste toner) is transported to the waste-toner container 326. When the toner is stored in the waste-toner container 326, at S1214 the waste amount calculator 395*d* calculates the accumulative waste amount, and, at S1205, the transfer amount calculator 395*c* calculates the accumulative transfer amount.

By contrast, when the partition shutter 325*j* is at the open position to reuse collected toner (No at S1213) at the start of image formation, the collected toner (i.e., reused toner) is transported to the developing device 323. Then, at S1215 the transfer amount calculator 395*c* calculates the accumulative transfer amount.

The process starting from steps S1201 is repeated until the image forming apparatus 1 is turned off. When the image forming apparatus 1 is turned off (Yes at S1216), switching between disposal and reuse in the toner collecting device 325 is completed.

Next, the required waste amount calculated as the count A at S1205 in FIG. 12 is described in detail below.

Typical developer (i.e., toner) used in electrophotographic image forming apparatuses is degraded while being exposed to heat, humidity, and outside air, and the degradation progresses with time as the developer is simply supplied from a toner bottle to the developing device. It is to be noted that, since an interior of the toner bottle is isolated from outside, the description below is on the assumption that deterioration of developer inside the toner bottle does not progress with time.

Developer is also degraded by friction with the developer conveying screw to transport developer inside the developing device in the main scanning direction, and the deterioration of developer progresses with time as the driving amount of the developer conveying screw increases.

Accordingly, to guarantee the image quality, it is desirable that toner supplied to the developing device is consumed (i.e., transferred) within a predetermined period before the toner supplied from the toner bottle is degraded or the driving amount reaches a threshold for the deterioration of toner. That is, it is desirable the supplied toner is transferred within a guarantee period or driving amount during which toner quality is guaranteed. Depending on environmental conditions and operating conditions, however, not all of the supplied toner is transferred in the guarantee period or driving amount.

By disposing the toner remaining after the guarantee period or driving amount as waste toner, images can be formed with toner not yet degraded, thus securing the image quality.

The term "required waste amount" used in this specification means the amount of toner not transferred within such a guarantee period or driving amount and thus to be disposed before subsequent image formation to secure image quality.

In electrophotographic image forming apparatuses, however, fresh toner is supplied from the toner bottle when the amount of toner in the developing device falls under a predetermined amount while image formation is repeated. Accordingly, degraded toner is mixed with fresh toner in the developing device, and in practice, it is not feasible to selectively dispose the toner that is not transferred within the guarantee period or driving amount.

Therefore, in the image forming apparatus 1 according to the present embodiment, considering the amount of toner transferred for image formation, toner is disposed from the developing device 323 little by little, and fresh toner is supplied from the toner supply assembly 350 to the developing device 323 to compensate for the disposed amount, thereby keeping the content rate of degraded toner (hereinafter "toner degradation rate") in the developing device 323 below a threshold to guarantee image quality (hereinafter "quality guarantee threshold"). This is because toner in the developing device 323 is replaced with fresh toner by the amount corresponding to the amount of toner transferred or disposed.

Although descriptions below concern a case where the toner degradation rate in the developing device 323 represents an indicator of quality degradation of toner in the developing device 323 (hereinafter simply "toner degradation indicator"), the toner degradation indicator in the developing device 323 is not limited thereto. Alternatively, in another embodiment, the toner degradation indicator in the developing device 323 is, for example, content rate of toner not yet degraded, content rate of positively charged toner and insufficiently charged toner, content rate of negatively charged toner, or charge amount of toner in the developing device 323.

When the toner degradation rate serves as the above-described toner degradation indicator, the degree of degradation increases as the toner degradation rate increases. By contrast, when the content rate of toner not yet degraded in the developing device 323 serves as the toner degradation indicator, the degree of degradation decreases as the content rate increases. Additionally, when the content rate of positively charged toner and insufficiently charged toner in the developing device 323 serves as the toner degradation indicator, the degree of degradation increases as the content rate increases. Additionally, when the content rate of negatively charged toner in the developing device 323 serves as the toner degradation indicator, the degree of degradation decreases as the content rate increases. Additionally, when the charge amount of toner in the developing device 323 serves as the toner degradation indicator, the degree of degradation increases as the charge amount increases. Accordingly, the quality guarantee threshold changes depending on the type of toner degradation indicators.

When the image forming apparatus 1 keeps transferring toner at a speed equal to or higher than a predetermined transfer pace (i.e., the ideal transfer pace stored in the setting data memory 394), the toner degradation rate in the developing device 323 is deemed at or lower than the quality guarantee threshold, and the image forming apparatus 1 determines not to dispose the toner inside the developing device 323. By contrast, when the image forming apparatus 1 keeps transferring toner at a speed lower than the predetermined ideal transfer pace, the toner degradation rate in the developing device 323 is deemed at or higher than the quality guarantee threshold, and the image forming apparatus 1 determines to dispose the toner from the developing device 323. It is to be noted that, in the present specification, the term "transfer pace" is represented by weight of toner transferred in image formation per unit time. Alternatively, "transfer pace" is represented by weight of toner transferred in image formation per unit driving amount of the developer conveying screws 323*a* and 323*b*.

Thus, in the present embodiment, the ideal transfer pace is predetermined and stored in the setting data memory 394. When the actual transfer pace is not lower than the ideal transfer pace, the image forming apparatus 1 (in particular, the switching determiner 393) determines not to dispose the toner inside the developing device 323, deeming the toner degradation rate in the developing device 323 lower than the quality guarantee threshold. By contrast, when the actual transfer pace is lower than the ideal transfer pace, the image forming apparatus 1 determines to dispose the toner inside the developing device 323, deeming the toner degradation rate in the developing device 323 equal to or higher than the quality guarantee threshold.

When the image forming apparatus 1 determines to dispose toner from the developing device 323, the image forming apparatus 1 calculates the amount of toner supposed to have been disposed until that time as "required waste amount", instead of the above-described required waste amount originally meant.

Calculation of required waste amount is described below.

The switching determiner 393 according to the present embodiment calculates a preferred transfer amount prior to calculation of required waste amount. That is, the switching determiner 393 serves as a transfer amount determiner as well. Then, the switching determiner 393 calculates, as the required waste amount, a difference between the calculated preferred transfer amount and the accumulative transfer amount calculated or measured by the transfer amount calculator 395*c*.

The term "preferred transfer amount" means the amount in total of toner to be transferred during the target period. The preferred transfer amount is calculated by either multiplying the above-described ideal transfer pace (weight per unit time) by the elapsed time during the target period or multiplying the ideal transfer pace (weight per unit driving amount) by the driving amount during the target period. Specifically, when the ideal transfer pace (weight per unit time) is represented by Tr1 and the elapsed time is represented by T, the preferred transfer amount based on the elapsed time (T) is expressed as "Tr1×T". In this case, the count A (required waste amount) is expressed as:

$$Tr1 \times T - W \qquad \text{Formula 1}$$

wherein W represents the accumulative transfer amount. By contrast, when the ideal transfer pace (weight per unit driving amount) is represented by Tr2 and the driving amount of the developer conveying screws 323*a* and 323*b* is represented by R, the preferred transfer amount based on the driving amount is expressed as "Tr2×R". In this case, the count A (required waste amount) is expressed as:

$$Tr2 \times R - W \qquad \text{Formula 2}$$

The switching determiner 393 calculates the count A (the required waste amount) as defined above at S1205 in FIG. 12. Thus, the degree of accuracy in calculating the count A (required waste amount) is relatively high.

It is to be noted that, according to the definition above, the preferred transfer amount is the total amount of toner to be transferred to keep the toner degradation rate at least at the quality guarantee threshold during the target period without disposing toner from the developing device 323. The term "accumulative transfer amount" means the amount in total of toner transferred in image formation during the target period. Thus, "preferred transfer amount" calculated as the count A is the difference obtained by deducting the total amount of toner actually transferred in the target period from the total amount of toner to be transferred to keep the toner degradation rate at least at the quality guarantee threshold through the target period without disposing toner.

When the required waste amount (count A) is zero, the switching determiner 393 determines that disposal of collected toner is not necessary because the amount of toner transferred during the target period is identical to the preferred transfer amount, that is, the pace at which toner in the developing device 323 degrades (hereinafter "toner degradation pace") is identical to the pace of toner supply from the toner supply assembly 350 to the developing device 323 to compensate for the transferred toner. Accordingly, the toner degradation rate in the developing device 323 is kept at the quality guarantee threshold regardless of increases in elapsed time or driving amount.

Additionally, when the required waste amount (count A) is smaller than zero (A<0), the switching determiner 393 determines that disposal of collected toner is not necessary because the toner degradation rate in the developing device 323 lowers gradually and falls below the quality guarantee threshold in time as the elapsed time or driving amount increases. Specifically, when the required waste amount is smaller than zero (A<0), the amount of toner transferred during the target period exceeds the preferred transfer amount, that is, the pace of toner supply from the toner supply assembly 350 to the developing device 323 to compensate for the transferred toner is faster than toner degradation pace in the developing device 323.

By contrast, in the case of the required waste amount (count A)>0, the switching determiner 393 determines that disposal of collected toner is necessary because the amount of toner transferred during the target period is insufficient for the preferred transfer amount, that is, toner degradation pace in the developing device 323 is faster than the pace of toner supply from the toner supply assembly 350 to the developing device 323 to compensate for the transferred toner. Accordingly, the toner degradation rate in the developing device 323 increases gradually and exceeds the quality guarantee threshold.

In the case where the required waste amount (count A)>0, the required waste amount means the amount in total of toner to be disposed to alleviate the toner degradation rate in the developing device 323 at least to the quality guarantee threshold. That is, in the case where the required waste amount (count A)>0, if the amount of toner identical to the required waste amount is disposed and replaced with toner supplied from the toner supply assembly 350, the toner degradation rate in the developing device 323 is lowered at least to the quality guarantee threshold. Thus, in such cases, the image forming apparatus 1 according to the present embodiment can calculate, with higher degree of accuracy, the amount in total of toner to be disposed to lower the toner degradation rate in the developing device 323 to the quality guarantee threshold.

The reason for the determination of reuse of collected toner (S1207 in FIG. 12) in the case of the count A≤0 (Yes at S1206) is described below.

As described above, when the required waste amount is not greater than zero (A≤0), the toner degradation rate in the developing device 323 is lower than the quality guarantee threshold. That is, the amount of toner transferred during the target period exceeds the preferred transfer amount, and the pace of toner supply from the toner supply assembly 350 to compensate for the transferred toner is faster than the toner degradation pace in the developing device 323.

Therefore, when the required waste amount is zero or smaller (A≤0), the switching determiner 393 determines to reuse the toner collected from the photoconductor drum 321.

Next, descriptions are given below the reason of determination between reuse and disposal of collected toner (S1207/S1210) based on comparison between the counts A and B (S1209) in the case of the count A>0 (No at S1206).

As described above, when the required waste amount is greater than zero, the required waste amount calculated as the count A means the total amount of toner to be disposed to lower the toner degradation rate in the developing device 323 to the quality guarantee threshold, and the accumulative waste amount measured as the count B is the amount of toner that has been disposed in the target period.

Accordingly, when the count A (required waste amount) is greater than zero and not greater than the count B (accumulative waste amount), that is, A>0 and A≤B, the switching determiner 393 judges that the toner degradation rate in the developing device 323 is lower than the quality guarantee threshold. Then, the switching determiner 393 determines to reuse the toner collected from the photoconductor drum 321 because an excessive amount of toner has been disposed, that is, the amount of toner disposed and replaced with supplied toner has already reached or exceeded the amount of toner disposed to keep the toner degradation rate lower than the quality guarantee threshold. In this state, the toner degradation rate is lower than the quality guarantee threshold.

By contrast, when the count A (required waste amount) is greater than zero and greater than the count B (accumulative waste amount), that is, A>0 and A>B, the switching determiner 393 judges that the toner degradation rate in the developing device 323 is higher than the quality guarantee threshold. Then, the switching determiner 393 determines to dispose the toner collected from the photoconductor drum 321 because the amount of toner that has been disposed until then is smaller than the amount of toner to be disposed to keep the toner degradation rate lower than the quality guarantee threshold. In this state, the toner degradation rate is higher than the quality guarantee threshold.

Thus, in the present embodiment, when the count A is greater than zero, which of the counts A and B is greater (magnitude relation) is correlated with the toner degradation rate in the developing device 323. Accordingly, the switching determiner 393 according to the present embodiment determines whether collected toner is disposed or reused according to the comparison between the counts A and B in the case of count A>0. Thus, at S1209, the switching determiner 393 determines reuse or disposal of collected toner based on the comparison result between the counts A and B.

It is to be noted that, when the count A is greater than the count B, that is, the toner degradation rate in the developing device 323 is higher than the quality guarantee threshold, the difference calculated by deducting the count B from the count A (A−B) means remaining of toner to be disposed in the target period to lower the toner degradation rate to the quality guarantee threshold.

As described above, in one aspect of the present embodiment, whether collected toner is disposed or reused is determined based on comparison between the count A and count B. Thus, the image forming apparatus 1 according to the present embodiment property determines whether collected toner is disposed or reused. Accordingly, the image forming apparatus 1 according to the present embodiment attains both of advantages attained by reuse of developer, such as reductions of environmental impact, running cost of the apparatus, and complexity of maintenance and management, and image quality guarantee.

It is to be noted that, although the switching determiner 393 determines to reuse the collected toner regardless of which of the counts A and B is greater in the case of the count A≤0 (Yes at S1206) in the flowchart in FIG. 12, alternatively, the switching determiner 393 may determine whether collected toner is disposed or reused according to the comparison between the counts A and B even when the count A≤0. In this case, effects similar to the present embodiment are available as well.

In the case of the count A≤0, however, without comparing the count A with the count B, reuse of collected toner can be determined based on the calculated count A, and thus the step of comparing can be omitted. That is, the processing in FIG. 12 in advantageous in eliminating the need of a step similar to S1209 in the case of the count A≤0 (Yes at S1206), thus simplifying the processing in determining the conveyance route of collected toner.

Additionally, although disposal of collected toner is determined in the case of the count A being greater than the count B (A>B) and reuse of collected toner is determined in the case of the count A being equal to or smaller than the count B (A≤B) in FIG. 12, in another embodiment, disposal of collected toner is determined in the case of the count A≥ the count B and reuse of collected toner is determined in the case of the count A< the count B. Yet in another embodiment, disposal of collected toner is determined in the case of the count A being greater than the count B, reuse of collected toner is determined in the case of the count A being smaller than the count B, and the state of the toner collecting device 325 is kept as is in the case of the count A being equal to the count B.

Additionally, in FIG. 12, although whether collected toner is disposed or reused is determined based on the required waste amount being the count A and the accumulative waste amount being the count B, in another embodiment, whether collected toner is disposed or reused is determined based on the preferred transfer amount being the count A and the sum of the accumulative transfer amount and the accumulative waste amount (hereinafter "accumulative toner consumption") being the count B.

Since the required waste amount is the difference calculated by deducting the accumulative transfer amount from the preferred transfer amount as described above, comparison between the required waste amount and the accumulative waste amount is equivalent to comparison between the preferred transfer amount and the accumulative toner consumption (accumulative transfer amount+accumulative waste amount). Accordingly, in such a configuration, the correlation between the magnitude relation of the counts A and B and determination of whether collected toner is disposed or reused is similar to that in the processing in FIG. 12.

Specifically, even in the configuration in which handling of collected toner is determined according to comparison between the preferred transfer amount being the count A and the accumulative toner consumption (accumulative consumption of developer) being the count B, disposal of collected toner is determined in the case of the count A being greater than the count B, whereas reuse of collected toner is determined in the case of the count A being equal to or smaller than the count B. Alternatively, the switching between disposal and reuse in the toner collecting device 325 may be kept as is in the case of the count A being equal to the count B.

It is to be noted that, in this case, the preferred transfer amount does not fall below zero, and it is not necessary to consider the case of the count A<0.

Additionally, in this configuration, the switching determiner 393 calculates the accumulative toner consumption using the accumulative transfer amount, calculated by the transfer amount calculator 395*c*, and the accumulative waste amount, calculated by the waste amount calculator 395*d*. Thus, in this configuration, the switching determiner 393 serves as a consumption estimator to estimate an accumulative consumption of developer.

Although the description above concerns the case where the count A is the required waste amount, which is the difference calculated by deducting the accumulative transfer amount from the preferred transfer amount, and the count B is the accumulative waste amount, similar effects are available also in cases where the counts A and B are defined to lead to the comparison between the required waste amount (=preferred transfer amount−accumulative transfer amount) and the accumulative waste amount.

Yet additionally, although, in the description above, the driving amount measuring portion 395*b* obtains the driving amount of the developer conveying screws 323*a* and 323*b* (i.e., a developer conveying member disposed in a route through which developer flows), in another embodiment, the driving amount measuring portion 395*b* detects the driving amount of another component, such as the photoconductor drum 321, the collected-collected-toner conveying screw 325*b*, the developing roller 323*c*, or the like. As the driving amount of such component increases, the toner degradation rate in the developing device 323 increases similarly.

Second Embodiment

In the above-described first embodiment, the required waste amount serving as the count A is calculated by deducting the accumulative transfer amount from the preferred transfer amount.

The degradation progress of toner used in electrophotographic image forming apparatuses varies depending on environments in which the apparatus is used such as temperature and humidity, manners how the apparatus operates (i.e., operating conditions such as transfer pace, and the like). Accordingly, to enhance the accuracy of calculation of count A (i.e., required waste amount), it is advantageous that the count A is adjusted according to environmental conditions under which the apparatus is used, manners how the apparatus operates, or both. It is to be noted that the term "operating conditions" in the specification includes the environmental conditions, which are either inside the image forming apparatus 1 or environment surrounding the image forming apparatus 1.

A second embodiment described below includes such adjustment of count A according to the operating conditions.

It is to be noted that elements of the present embodiment similar to those of the first embodiment are given identical or similar reference characters, and thus descriptions thereof omitted.

Initially, descriptions are given below of operating conditions according to which the switching determiner 393 adjusts the count A. Under certain operating conditions, the switching determiner 393 according to the present embodiment does not adjust the count A. For example, adjustment of count A is not necessary in environments or under conditions recommended by the manufacturer of toner. In this specification, such recommended environments or conditions are referred to as standard conditions.

Under operating conditions better than the standard conditions for toner, the degradation progress of toner is slower, and the switching determiner 393 makes an adjustment accordingly. By contrast, under operating conditions worse than the standard conditions for toner, the degradation progress of toner is faster, and the switching determiner 393 makes an adjustment accordingly. Thus, in the present embodiment, the switching determiner 393 adjusts the count A according to the operating conditions.

Hereinafter the count A after adjustment is referred to as an adjusted count Aa. When C represents an amount by which the count A is thus adjusted, the adjusted count Aa is expressed as Formula 3 or 4 using Formula 1 or 2 described above.

$$Aa=Tr1\times T-W+C \quad \text{Formula 3}$$

$$Aa=Tr2\times R-W+C \quad \text{Formula 4}$$

Next, descriptions are given below of adjustment of count A according to environments (e.g., humidity and temperature) and operating conditions (i.e., content of reused toner, transfer pace, smoothness of paper, background fog, and driving amount), respectively with reference to FIGS. 13 through 21.

Figure 13:
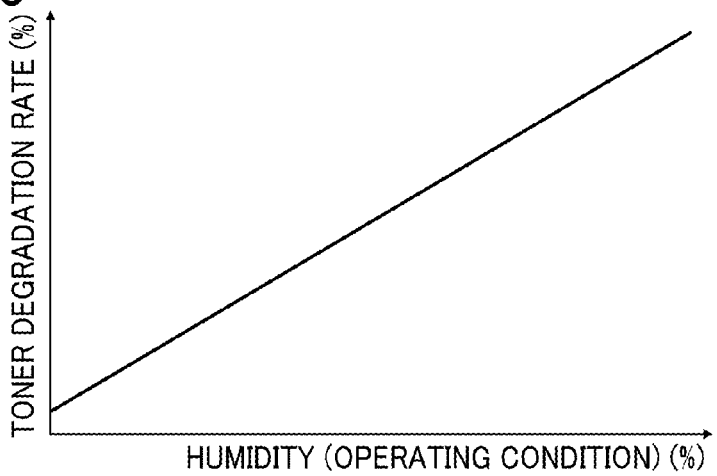
FIG. 13 is a graph of toner degradation rate according to an embodiment relative to humidity.

FIG. 13 is a graph of relation between humidity under which the apparatus is used and degradation rate of toner used in the image forming apparatus 1 according to the present embodiment.

As shown in FIG. 13, in accordance with humidity, the toner degradation rate varies. The image forming apparatus 1 according to the present embodiment includes the environment sensor 201 (shown in FIGS. 3 and 10) to detect humidity either inside or outside the image forming apparatus 1.

Accordingly, the image forming apparatus 1 according to the present embodiment adjusts the count A according to humidity so that the switching determiner 393 can determine disposal or reuse of collected toner more properly.

As shown in FIG. 13, the toner degradation rate tends to increase as humidity increases. Accordingly, the image forming apparatus 1 adjusts the count A (i.e., required waste amount) to a greater setting as humidity increases.

Specifically, the switching determiner 393 according to the present embodiment calculates a humidity-based correction amount C1 using the following formula:

$$C1=(C11-C12)\times C13 \quad \text{Formula 5}$$

wherein C11 represents the humidity under which the image forming apparatus 1 is used, C12 represents humidity as a standard condition (i.e., reference humidity), and C13 represents a humidity-based adjustment coefficient.

It is to be noted that the humidity-based adjustment coefficient is either a predetermined positive constant or a variable depending on the environmental conditions.

Next, adjustment of count A according to temperature is described below with reference to FIG. 14, which is a graph of relation between temperature under which the image forming apparatus 1 is used and degradation rate of toner used therein.

Figure 14:
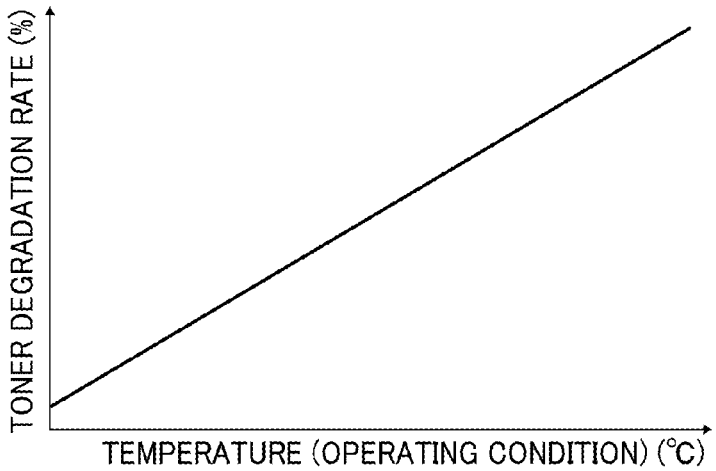
FIG. 14 is a graph of toner degradation rate according to an embodiment relative to temperature.

As shown in FIG. 14, in accordance with temperature, the toner degradation rate varies. In this case, the environment sensor 201 serves as a thermometer to detect temperature either inside or outside the image forming apparatus 1.

Accordingly, adjusting the count A according to temperature under which the apparatus operates contributes to proper determination of disposed or reused of collected toner by the switching determiner 393.

As shown in FIG. 14, the toner degradation rate tends to increase as temperature rises. Accordingly, the image forming apparatus 1 adjusts the count A to a greater setting as temperature rises.

Specifically, the switching determiner 393 in the present embodiment calculates a temperature-based correction amount C1 using the following formula:

$$C1=(C11-C12)\times C13 \quad \text{Formula 6}$$

wherein C11 represents the humidity under which the image forming apparatus 1 is used, C12 represents temperature under the standard conditions, and C13 represents a temperature-based adjustment coefficient.

It is to be noted that the temperature-based adjustment coefficient is either a predetermined positive constant or a variable depending on the operating conditions.

Figure 15:
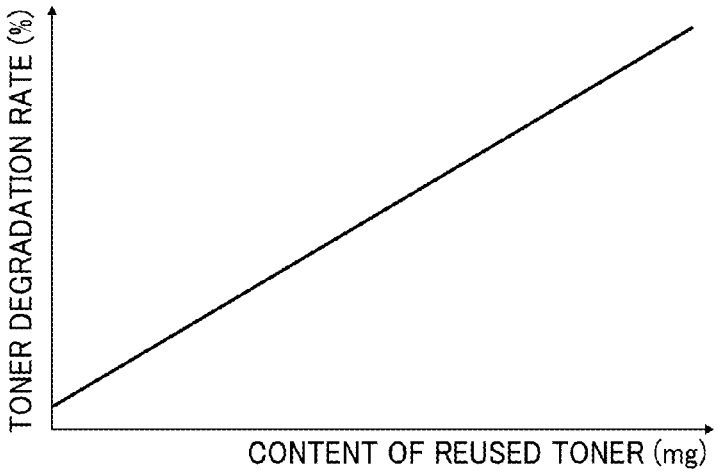
FIG. 15 is a graph of toner degradation rate relative to content rate of reused toner inside a developing device according to an embodiment.

Next, descriptions are given below of adjustment of count A according to the content of reused toner in the developing device 323. FIG. 15 is a graph of relation between the toner degradation rate (i.e., the content of degraded toner) and the content of reused toner in the developing device 323.

As shown in FIG. 15, the toner degradation rate varies depending on the content of reused toner. It is to be noted that, the content of reused toner in the developing device 323 is calculated, for example, based on the driving amount (i.e., the rotation speed, rotation distance, driving time, or the like) of the collected-toner conveying screw 325*b* in the state in which the partition shutter 325*j* is open to guide collected toner to the reuse channel 325*i*. Alternatively, the content of reused toner in the developing device 323 is calculated from the pixel data included in the output data, obtained from the engine controller 120 via the controller interface 392, and the efficiency in transferring toner from the photoconductor drum 321 onto the sheet 2.

The image forming apparatus 1 according to the present embodiment adjusts the count A according to the content of reused toner in toner in the developing device 323 so that the switching determiner 393 can determine disposal or reuse of collected toner more properly.

Additionally, since the toner degradation rate tends to increase as the content of reused toner increases as shown in FIG. 15, the image forming apparatus 1 adjusts the count A (i.e., required waste amount) to a greater value as the content of reused toner increases.

Specifically, the switching determiner 393 according to the present embodiment calculates a correction amount based on the reused-toner content (C3) using the following formula:

$$C3=(C31-C32)\times C33 \quad \text{Formula 7}$$

wherein C31 represents the content of reused toner in toner in the developing device 323 under the operating conditions, C32 represents the content of reused toner in toner in the developing device 323 under the standard conditions, and C33 represents an adjustment coefficient based on the reused toner content.

It is to be noted that the adjustment coefficient based on the reused toner content is either a predetermined positive constant or a variable depending on the operating conditions.

Next, descriptions are given below of adjustment of count A according to the transfer pace with reference to FIG. 16, which is a graph of relation between the toner degradation rate and the transfer pace of toner.

Figure 16:
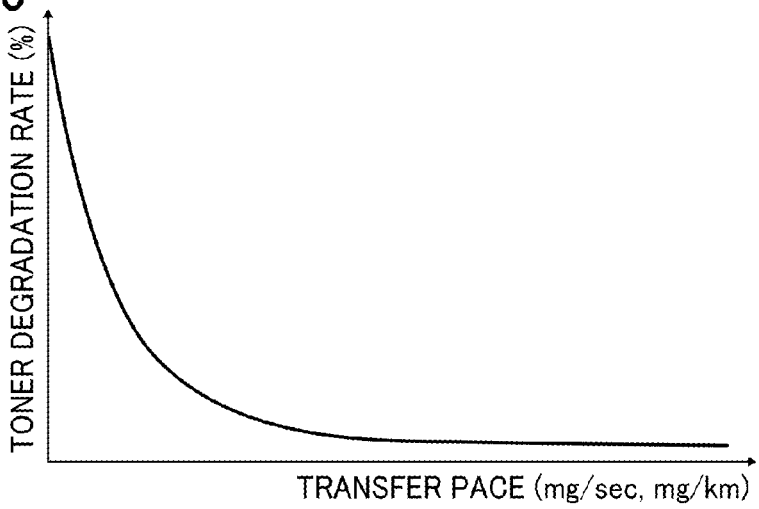
FIG. 16 is a graph of toner degradation rate in the developing device according to an embodiment relative to toner transfer pace.

As shown in FIG. 16, the toner degradation rate varies depending on the transfer pace of toner. It is to be noted that the transfer pace in the present embodiment is similar to that defined in the first embodiment and calculated, for example, by dividing the accumulative transfer amount by either the elapsed time or the driving amount of the developer conveying screws 323*a* and 323*b* in the target period.

The image forming apparatus 1 according to the present embodiment adjusts the count A according to the transfer pace under the operating conditions so that the switching determiner 393 can determine disposal or reuse of collected toner more properly.

Since the toner degradation rate tends to decrease as the transfer pace increases as shown in FIG. 16, the image forming apparatus 1 adjusts the count A (i.e., required waste amount) to a smaller value as the transfer pace increases.

Specifically, the switching determiner 393 in the present embodiment calculates a correction amount C4 based on transfer pace using the following formula:

$$C4=-(C41-C42)\times C43 \quad \text{Formula 8}$$

wherein C41 represents the transfer pace under the operating conditions, C42 represents the transfer pace under the standard conditions, and C43 represents a transfer-pace based adjustment coefficient. It is to be noted that the transfer-pace based adjustment coefficient is either a predetermined positive constant or a variable depending on the operating conditions.

Next, descriptions are given below of adjustment of count A according to smoothness of transfer sheets with reference to FIGS. 17 and 18.

Figure 17:
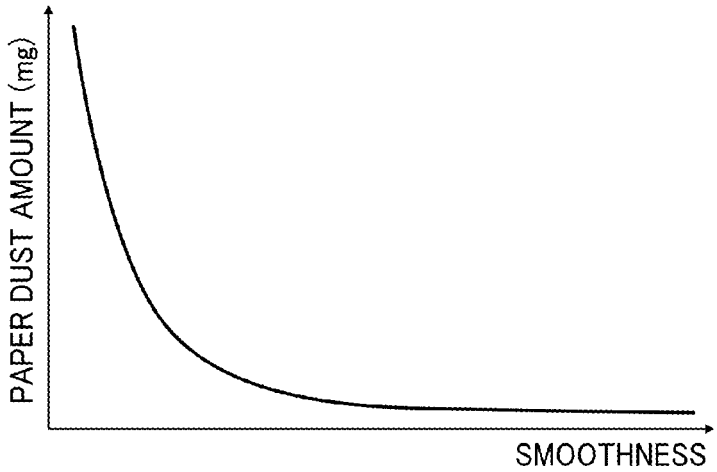
FIG. 17 is a graph of relation between the amount of paper dust mixed in toner inside the developing device according to an embodiment and smoothness of transfer sheets.

FIG. 17 is a graph of relation between the amount of paper dust mixed in toner used in the image forming apparatus 1 and smoothness of transfer sheets. FIG. 18 is a graph of relation between apparent degradation progress of toner used in the image forming apparatus 1 and the amount of paper dust mixed in the toner. FIG. 19 is a graph of relation between the apparent degradation progress of toner used in the image forming apparatus 1 and smoothness of transfer sheets.

As shown in FIG. 17, the amount of paper dust mixed in toner varies depending on the smoothness of transfer sheets. Specifically, the amount of paper dust mixed in toner decreases as the smoothness of transfer sheets increases. As the smoothness thereof decreases, the surface of the transfer sheet becomes rough, and accordingly paper dust from the transfer sheet is more likely to adhere to the photoconductor drum 321. It is to be noted that the smooth of transfer sheets are measured by the smoothness sensor 240 shown in FIG. 3 or 4.

Figure 18:
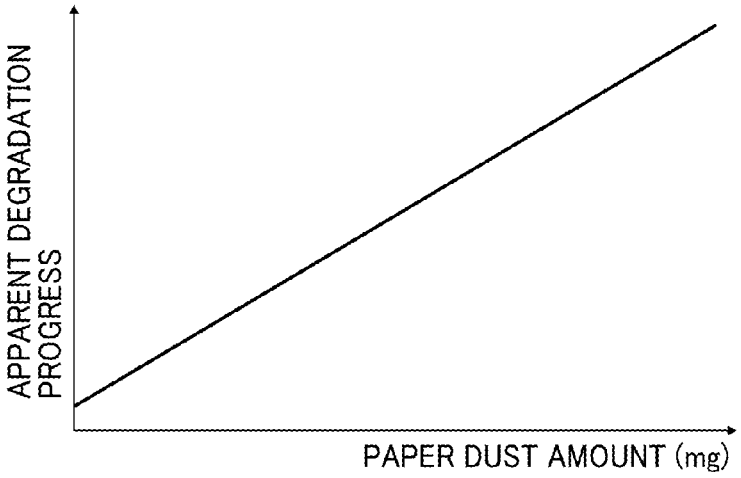
FIG. 18 is a graph of relation between apparent degradation progress of toner according to an embodiment and the amount of paper dust mixed in toner.
Figure 19:
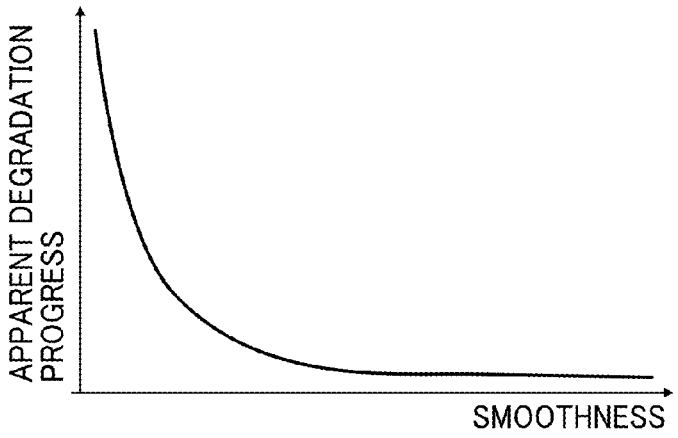
FIG. 19 is a graph of relation between the apparent degradation progress of toner inside the developing device according to an embodiment and smoothness of transfer sheets.

Referring to FIG. 18, the apparent degradation progress of toner tends to increase as the amount of paper dust mixed in toner increases. Even if toner itself is not degraded, mixing of paper dust in toner causes a phenomenon similar to a phenomenon that arises when toner is degraded, and thus the toner is deemed degraded.

Then, from the relation shown in FIGS. 17 and 18, the apparent degradation progress of toner used in the image forming apparatus 1 varies depending on the smoothness of transfer sheets as shown in FIG. 19.

Accordingly, the image forming apparatus 1 adjusts the count A according to the smoothness of transfer sheets so that the switching determiner 393 can determine disposal or reuse of collected toner more properly.

Since the apparent degradation progress of toner tends to decrease as the smoothness of transfer sheets increases as shown in FIG. 19, the image forming apparatus 1 adjusts the count A (i.e., required waste amount) to a smaller value as the smoothness increases.

Specifically, the switching determiner 393 in the present embodiment calculates a smoothness-based correction amount C5 using the following formula:

$$C5=-(C51-C52)\times C53 \qquad \text{Formula 9}$$

wherein C51 represents the transfer sheet smoothness under the operating conditions, C52 represents reference transfer sheet smoothness (i.e., standard conditions), and C53 represents a smoothness-based adjustment coefficient. It is to be noted that the smoothness-based adjustment coefficient is either a predetermined positive constant or a variable depending on the operating conditions.

Next, descriptions are given below of adjustment of count A according to background fog under the operating conditions.

It is preferred that toner adhere only to image portions on the outer circumferential face of the photoconductor drum 321 and do not adhere to a background of the image portions (i.e., background areas). However, toner can adhere to areas other than image portions, and toner adhering to areas other than image portions on the outer circumferential face of the photoconductor drum 321 is called "background fog toner" (background stains) in this specification. It is to be noted that the amount of background fog toner is measured by an adhering toner sensor 329 (shown in FIG. 10), which is a reflective photosensor, for example. The background fog toner is transferred onto the transfer sheet or disposed in the waste-toner container 326, and thus the amount of background fog toner is deducted from the count A.

Accordingly, the image forming apparatus 1 according to the present embodiment adjusts the count A according to background fog toner, adhering to the outer circumferential face of the photoconductor drum 321, under the operating conditions so that the switching determiner 393 can determine disposal or reuse of collected toner more properly.

Since the background fog toner is either transferred onto the transfer sheet or disposed in the waste-toner container 326, the count A (i.e., required waste amount) is adjusted to a smaller value as the amount of background fog toner increases.

Specifically, the switching determiner 393 according to the present embodiment calculates a correction amount based on the amount of background fog toner (C6) using the following formula:

$$C6=-(C61-C62)\times C63 \qquad \text{Formula 10}$$

wherein C61 represents the amount of background fog toner under the operating conditions, C62 represents the amount of background fog toner under the standard conditions (i.e., reference amount of background fog toner), and C63 represents an adjustment coefficient based on background fog toner. It is to be noted that the adjustment coefficient (C63) based on background fog toner is either a predetermined positive constant or a variable depending on the operating conditions.

Next, descriptions are given below of adjustment of count A according to the driving amount of the developer conveying screws 323*a* and 323*b* under the operating conditions with reference to FIG. 20.

Figure 20:
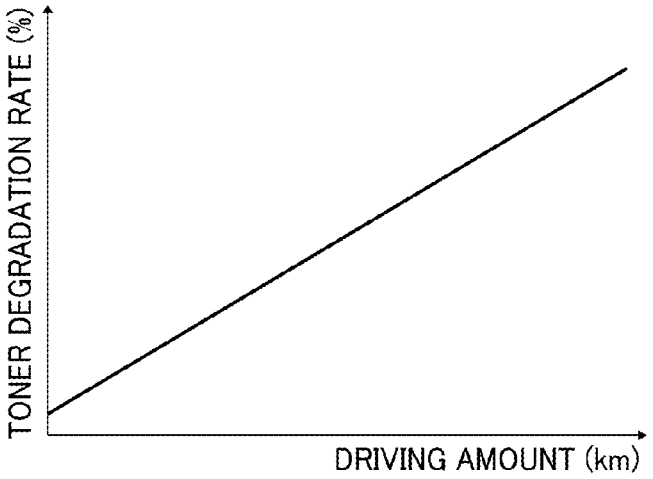
FIG. 20 is a graph of degradation rate of toner used in an image forming apparatus according to an embodiment relative to a driving amount of a developer conveying screw.

FIG. 20 is a graph of the toner degradation rate relative to the driving amount of the developer conveying screws 323*a* and 323*b*. As shown in FIG. 20, the toner degradation rate varies depending on the driving amount of the developer conveying screws 323*a* and 323*b*.

Accordingly, the image forming apparatus 1 according to the present embodiment adjusts the count A according to the driving amount of the developer conveying screws 323*a* and 323*b* under the operating conditions so that the switching determiner 393 can determine disposal or reuse of collected toner more properly.

Since the toner degradation rate tends to increase as the driving amount of the developer conveying screws 323*a* and 323*b* increases as shown in FIG. 20, the image forming apparatus 1 adjusts the count A (i.e., required waste amount) to a greater value as the driving amount increases.

Specifically, the switching determiner 393 according to the present embodiment calculates a correction amount (C7) based on the driving amount using the following formula:

$$C7=(C71-C72)\times C73 \qquad \text{Formula 11}$$

wherein C71 represents the driving amount of the developer conveying screws 323*a* and 323*b* under the operating conditions, C72 represents the driving amount of the developer conveying screws 323*a* and 323*b* under the standard conditions, and C73 represents an adjustment coefficient based on the driving amount. It is to be noted that the adjustment coefficient based on the driving amount is either a predetermined positive constant or a variable depending on the operating conditions.

Next, descriptions are given below of adjustment of count A according to the driving amount of the collected-toner conveying screw 325*b* under the operating conditions with reference to FIG. 21.

Figure 21:
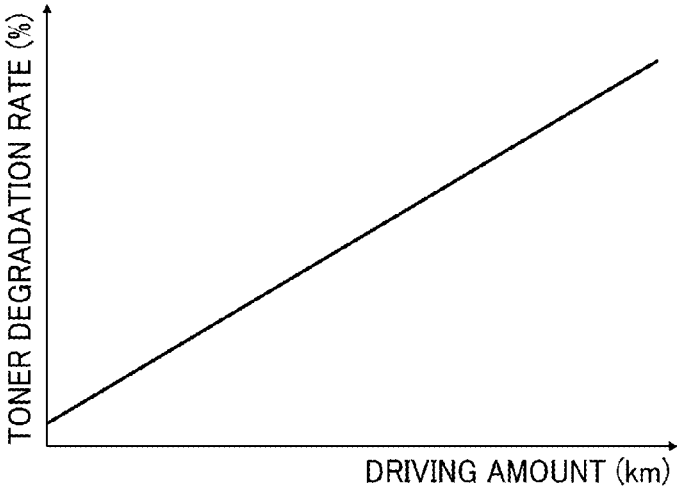
FIG. 21 is a graph of the amount of toner disposed in a waste-toner container according to an embodiment relative to a driving amount of a collected-toner conveying screw.

FIG. 21 is a graph of the amount of toner disposed in the waste-toner container 326 relative to the driving amount of the collected-toner conveying screw 325*b*.

As shown in FIG. 21, the amount of toner disposed in the waste-toner container 326 varies depending on the driving amount of the collected-toner conveying screw 325*b* because efficiency in transporting collected toner to the collected-toner channel 325*d* increases as the driving amount of the collected-toner conveying screw 325*b* increases, thereby increasing the amount of toner disposed in the waste-toner container 326.

Accordingly, the image forming apparatus 1 according to the present embodiment adjusts the count A according to the driving amount of the collected-toner conveying screw 325*b* under the operating conditions so that the switching determiner 393 can determine disposal or reuse of collected toner more properly.

Since the amount of toner disposed in the waste-toner container 326 tends to increase as the driving amount of the collected-toner conveying screw 325*b* increases as shown in FIG. 21, the image forming apparatus 1 adjusts the count A (i.e., required waste amount) to a greater value as the driving amount increases.

Specifically, the switching determiner 393 according to the present embodiment calculates a correction amount (C8) based on the driving amount of the collected-toner conveying screw 325*b* using the following formula:

$$C8=(C81-C82)\times C83 \qquad \text{Formula 12}$$

wherein C81 represents the driving amount of the collected-toner conveying screw 325*b* under the operating conditions, C82 represents the driving amount of the collected-toner conveying screw 325*b* under the standard conditions, and C83 represents an adjustment coefficient based on the driving amount of the collected-toner conveying screw 325*b*.

It is to be noted that the adjustment coefficient based on the driving amount of the collected-toner conveying screw 325*b* is either a predetermined positive constant or a variable depending on the operating conditions.

As described above, the image forming apparatus 1 according to the present embodiment adjusts the count A (i.e., required waste amount) according to environmental conditions, for example, humidity and temperature under which the apparatus is used, and operating conditions, for example, the content of reused toner in the developing device 323, the transfer pace, the smoothness of transfer sheets, the amount of background fog toner on the outer circumferential face of the photoconductor drum 321, the driving amount of the developer conveying screws 323*a* and 323*b*, and the driving amount of the collected-toner conveying screw 325*b*.

In other words, the switching determiner 393 calculates the adjusted count Aa (Aa=Tr1×T−W+C) using the following formula based on Formulas 3 and 5 through 12.

$$Aa=TR1\times T-W+C1+C2+C3+C4+C5+C6+C7+C8=TR1\times T-W+\{(C11-C12)\times C13\}+\{(C21-C22)\times C23\}+\{(C31-C32)\times C33\}-\{(C41-C42)\times C43\}-\{(C51-C52)\times C53\}-\{(C61-C62)\times C63\}+\{(C71-C72)\times C73\}+\{(C81-C82)\times C83\} \qquad \text{Formula 13}$$

Alternatively, the switching determiner 393 calculates the adjusted count Aa (Aa=Tr2×R−W+C) using the following formula based on Formulas 4 through 12.

$$Aa=TR2\times R-W+C1+C2+C3+C4+C5+C6+C7+C8=TR2\times R-W+\{(C11-C12)\times C13\}+\{(C21-C22)\times C23\}+\{(C31-C32)\times C33\}-\{(C41-C42)\times C43\}-\{(C51-C52)\times C53\}-\{(C61-C62)\times C63\}+\{(C71-C72)\times C73\}+\{(C81-C82)\times C83\} \qquad \text{Formula 14}$$

Thus, the degree of accuracy in calculating the count A (required waste amount) is relatively high.

It is to be noted that, although the description above concerns calculation of the adjusted count Aa according to the smoothness of transfer sheets on which images are formed, mixed in toner in the developing device 323. In this case, the sensor 231 (FIG. 3) to detect smear of the registration rollers 230 is used. The sensor 231 is to detect the degree of smear of (dust adhering to) the registration rollers 230. The image forming apparatus 1 converts the degree of smear of the registration rollers 230 into the amount of paper dust mixed in toner in the developing device 323 and then calculates the adjusted count Aa using the relation shown in FIG. 18.

Specifically, the switching determiner 393 calculates a correction amount (C9) based on paper dust using the following formula:

$$C9=(C91-C92)\times C93 \qquad \text{Formula 15}$$

wherein C91 represents the amount of paper dust mixed in toner in the developing device 323 under the operating conditions, C92 represents the amount of paper dust mixed in toner in the developing device 323 under the standard conditions, and C93 represents an adjustment coefficient based on paper dust. It is to be noted that the adjustment coefficient based on paper dust is either a predetermined positive constant or a variable depending on the operating conditions.

As described above, the image forming apparatus 1 according to the present embodiment adjusts the count A (i.e., required waste amount) according to environmental conditions and operating conditions, thereby enhancing the calculation accuracy of the count A.

Additionally, although, the count A is adjusted according to the driving amount of the developer conveying screws 323*a* and 323*b* (i.e., developer conveying members of the developing device) in the description above, in another embodiment, the count A is adjusted according to the driving amount of another component, such as the photoconductor drum 321, the collected-collected-toner conveying screw 325*b*, the developing roller 323*c*, or the like. In such cases, the count A is adjusted in a manner similar to the adjustment according to the driving amount of the developer conveying screws 323*a* and 323*b* because the toner degradation rate in the developing device 323 increases as the driving amount of such component increases similar to that of the developer conveying screws 323*a* and 323*b*. Additionally, in such cases, the respective adjustment coefficients can be variables that change according to the driving amount of such component.

The calculation formulas and the adjustment coefficients described above are stored in the setting data memory 394.

It is to be noted that although Formulas 13 and 14 are to adjust the count A according to all of the above-described operation conditions (e.g., humidity, temperature, content of reused toner, transfer pace, smoothness of paper, background fog, and driving amount), an aspect of the present embodiment is to adjust the count A according to at least one of the above-described operating conditions.

Third Embodiment

In the above-described first embodiment, the accumulative waste amount serving as the count B is measured according to the detection signals output from the toner sensor 326*a*. The toner sensor 326*a*, however, is not essential in the image forming apparatus 1 according to the present embodiment.

In the present embodiment, the accumulative waste amount serving as the count B is not measured but calculated. This configuration is advantageous in that the accumulative waste amount serving as the count B is estimated at lower cost. Thus, the present embodiment is advantageous in reducing the cost for property determining whether collected toner is disposed or reused, and reducing the cost for proper switching between disposed of collected toner and reused of collected toner. Therefore, in the present embodiment, advantages attained by reuse of developer and image quality guarantee are better balanced at lower cost.

It is to be noted that elements of the present embodiment similar to those of the first embodiment are given identical or similar reference characters, and thus descriptions thereof omitted.

Further, hereinafter the term "residual toner" means toner remaining on the outer circumferential face of the photoconductor drum 321 after the toner image is transferred therefrom onto a transfer medium such as the transfer sheet or an intermediate transfer member.

Descriptions are given below of calculation of residual toner disposed in the waste-toner container 326.

In this case, the waste amount calculator 395*d* according to the present embodiment calculates an amount added to the count B corresponding to the residual toner (hereinafter "residual toner added amount D1") using the following formula:

$$D1=D11\times D12\times(1-D13/100) \quad \text{Formula 16}$$

wherein D11 represents image area ($cm^2$) on the outer circumferential face of the photoconductor drum 321, D12 represents the amount per unit area of toner ($mg/cm^2$) adhering to the outer circumferential face of the photoconductor drum 321, and D13 represents a transfer rate (%) of toner form the photoconductor drum 321 onto the transfer sheet.

It is to be noted that, although each of D12 and D13 can be a predetermined constant, a variable depending on the operating conditions is advantageous in adjusting the residual toner added amount D1 to fit to the usage conditions. Thus, the degree of accuracy in calculating the count B (required waste amount) is relatively high.

Next, descriptions are given below of calculation of amount added corresponding to the remaining of background fog toner after transfer of the toner image from the photoconductor drum 321.

As described above in the second embodiment, toner can adhere to backgrounds (areas other than image portions) on the outer circumferential face of the photoconductor drum 321. The toner adhering to the background of image portions is distinguished from the toner to be transferred and called "background fog toner".

In this case, the waste amount calculator 395*d* according to the present embodiment calculates an amount D2 added to the count B corresponding to the residual toner on background using the following formula:

$$D2=(D22-D23)\times D24+(D23-D21)\times D24\times(1-D25/100) \quad \text{Formula 17}$$

wherein D21 represents image area ($cm^2$) on the outer circumferential face of the photoconductor drum 321, D22 represents a total area ($cm^2$) on the outer circumferential face of the photoconductor drum 321, D23 represents an area ($cm^2$) of the transfer sheet, D24 represents the amount per unit area of background fog toner ($mg/cm^2$) on the outer circumferential face of the photoconductor drum 321, and D25 represents a transfer rate (%) of background fog toner form the photoconductor drum 321 onto the transfer sheet.

It is to be noted that, although each of D24 and D25 can be a predetermined constant, a variable depending on the operating conditions is advantageous in that the waste amount calculator 395*d* calculates the amount D2 corresponding to residual toner on background to fit to the usage conditions. Thus, the degree of accuracy in calculating the count B (required waste amount) is relatively high.

The first term (D22−D23)×D24 and the second term (D23−D21)×D24×(1−D25/100) of Formula 14 are described in detail below.

In the first term (D22−D23)×D24, "D22−D23" means, on the outer circumferential face of the photoconductor drum 321, the area outside a transfer sheet area (on which an image is formed). The background fog toner in the area outside the transfer sheet area is not transferred onto the transfer sheet. Accordingly, the amount of residual toner on background corresponding to that area is calculated as (D22−D23)×D24 and added to the count B (i.e., accumulative waste amount).

In the second term (D23−D21)×D24×(1−D25/100), "D23−D21" means, on the outer circumferential face of the photoconductor drum 321, the area inside the transfer sheet area and corresponds to the background of the image. The background fog toner inside the transfer sheet area is transferred onto the transfer sheet. Accordingly, the amount of residual toner on background in that area is calculated as (D23−D21)×D24×(1−D25/100) and added to the count B (i.e., accumulative waste amount).

Next, descriptions are given below of a case where residual toner on the photoconductor drum 321 is collected and disposed in the waste-toner container 326 after an adjustment operation of the developing device 323.

The term "adjustment operation" means an operation to supply toner from the developing device 323 to the photoconductor drum 321 for purposes except standard image formation. Examples of adjustment operation include, but not limited to, process control for density adjustment and toner refreshment. In process control, for example, a predetermined area patch is set on the outer circumferential face of the photoconductor drum 321, density of toner is detected for each patch, and a bias (transfer bias, developing bias, or the like) is adjusted. Alternatively, the density of toner on the photoconductor drum 321 is adjusted. In toner refreshment, toner is, either partly or entirely, discharged from the developing device 323, and fresh toner is supplied from the toner supply assembly 350 to the developing device 323, thereby keeping the toner degradation rate in the developing device 323 lower than the quality guarantee threshold. The toner supplied to the photoconductor drum 321 in the adjustment operation is referred to as "adjustment toner". That is, in the present embodiment, toner refreshment serves as replacement of developer.

In this case, the waste amount calculator 395*d* according to the present embodiment calculates an amount added to the count B corresponding to the adjustment toner (hereinafter "adjustment toner added amount D3") using the following formula:

$$D3=D31\times D32 \quad \text{Formula 18}$$

wherein D31 represents a total area ($cm^2$) on the outer circumferential face of the photoconductor drum 321, and D32 represents the amount per unit area of adjustment toner ($mg/cm^2$) adhering to the outer circumferential face of the photoconductor drum 321.

It is to be noted that, although D32 can be a predetermined constant, a variable depending on the operating conditions is advantageous in adjusting the adjustment toner added amount D3 to fit to the usage conditions. Thus, the degree of accuracy in calculating the count B (required waste amount) is relatively high.

Thus, in the present embodiment, residual toner (in image portions), residual toner on background, and adjustment toner are added to the count B.

That is, the waste amount calculator 395*d* according to the present embodiment calculates an adjusted count Bb using Formulas 16 through 18 as follows.

$$Bb=D1+D2+D3=\{11\times D12\times(1-D13/100)\}+\{(D22-D23)\times D24+(D23-D21)\times D24\times(1-D25/100)\}+\{D31\times D32\} \quad \text{Formula 19}$$

Accordingly, the image forming apparatus 1 according to the present embodiment estimates the count B properly at lower cost.

It is to be noted that, as the driving amount of the collected-toner conveying screw 325*b* increases, the efficiency in transporting the collected toner to the collected-toner channel 325*d* increases, thus resulting in increases in the amount of toner disposed in the waste-toner container 326. Thus, since the amount of toner disposed in the waste-toner container 326 varies according to the driving amount of the collected-toner conveying screw 325*b*, it is advantageous in enhancing calculation accuracy of the adjusted count Bb to consider the driving amount of the collected-toner conveying screw 325*b*.

When E1 represents the driving amount of the collected-toner conveying screw 325*b* and E2 represents an adjustment coefficient at that time (i.e., driving amount adjustment coefficient), using Formula 19 mentioned above, the adjusted count Bb is expressed as:

$$Bb=(D1+D2+D3)\times E1\times E2=[\{D11\times D12\times(1-D13/100)\}+\{(D22-D23)\times D24+(D23-D21)\times D24\times(1-D25/100)\}+\{D31\times D32\}]\times E1\times E2 \quad \text{Formula 20}$$

It is to be noted that, although E2 can be a predetermined constant, a variable depending on the operating conditions is advantageous in adjusting the count B (i.e., accumulative waste amount) to fit to the usage conditions. Thus, the degree of accuracy in calculating the count B (required waste amount) is relatively high.

Additionally, even when the partition shutter 325*j* serving as the channel switching member is closed to set the conveyance route of collected toner to the waste channel 325*h*, it is possible that a part of collected toner undesirably flows to the reuse channel 325*i*. In that case, the amount of toner disposed in the waste-toner container 326 is reduced by the amount of such toner, and it is advantageous in enhancing calculation accuracy of the adjusted count Bb to consider the amount of toner that undesirably flows to the reuse channel 325*i* when the conveyance route of collected toner is set to the waste channel 325*h*. Using Formula 20 mentioned above, the adjusted count Bb is expressed as:

$$Bb=(D1+D2+D3)\times E1\times E2\times F=[\{D11\times D12\times(1-D13/100)\}+\{(D22-D23)\times D24+(D23-D21)\times D24\times(1-D25/100)\}+\{D31\times D32\}]\times E1\times E2\times F \quad \text{Formula 21}$$

wherein F represents an adjustment coefficient considering the amount of collected toner that undesirably flows to the reuse channel 325*i*.

Then, calculation accuracy of the adjusted count Bb (i.e., accumulative waste amount) is further enhanced at lower cost. It is to be noted that, although F can be a predetermined constant, a variable depending on the operating conditions is advantageous in adjusting the count B to fit to the usage conditions. Thus, the degree of accuracy in calculating the count B is relatively high.

Similarly, even when the partition shutter 325*j* is open to set the conveyance route of collected toner to the reuse channel 325*i*, it is possible that a part of collected toner undesirably flows to the waste channel 325*h*. In that case, the amount of toner disposed in the waste-toner container 326 is increased by the amount of such collected toner, and it is advantageous in enhancing calculation accuracy of the adjusted count Bb to consider the amount of toner that undesirably flows to the waste channel 325*h* when the conveyance route of collected toner is set to the reuse channel 325*i*.

Specifically, when the toner collecting device 325 is to reuse collected toner, calculation of the amount of collected toner transported to the developing device 323 is similar to calculation of the same in the case where the partition shutter 325*j* is closed to dispose collected toner.

That is, the amount of collected toner transported to the developing device 323 is expressed as:

$$[\{D'11\times D'12\times(1-D'13/100)\}+\{(D'22-D'23)\times D'24+(D'23-D'21)\times(D'24\times(1-D'25/100)\}+\{D'31\times D'32\}]\times E'1\times E'2\times F' \quad \text{Formula 22}$$

In Formula 22, D', E', and F' are constants or variables in the case where the partition shutter 325*j* is closed to dispose collected toner. For example, D11' corresponds to D11, and F' is an adjustment coefficient in which the amount flowing from the reuse channel 325*i* to the waste channel 325*h* is considered.

Accordingly, when the amount of toner that undesirably flows from the reuse channel 325*i* to the waste channel 325*h* is considered, using Formulas 21 and 22, the adjusted count Bb is expressed as:

$$Bb=[\{D11\times D12\times(1-D13/100)\}+\{(D22-D23)\times D24+(D23-D21)\times D24\times(1-D25/100)\}+\{D31\times D32\}]\times E1\times E2\times F+[\{D'11\times D'12\times(1-D'13/100)\}+\{(D'22-D'23)\times D'24+(D'23-D'21)\times D'24\times(1-D'25/100)\}+\{D'31\times D'32\}]\times E'1\times E'2\times(1-F'/100) \quad \text{Formula 23}$$

As described above, an aspect of the present embodiment is to obtain the count B (i.e., accumulative waste amount) by calculation. This configuration is advantageous in that the necessity of the toner sensor 326*a* is obviated in obtaining the accumulative waste amount, and the accumulative waste amount serving as the count B is estimated with a higher accuracy at lower cost. Thus, the present embodiment is advantageous in reducing the cost for property determining whether collected toner is disposed or reused, and reducing the cost for proper switching between disposed of collected toner and reused of collected toner. Therefore, in the present embodiment, advantages attained by reuse of developer and image quality guarantee are better balanced at lower cost.

Fourth Embodiment

The first through third embodiments described above concern switching of collected toner between disposal and reuse based on the comparison between the count A (required waste amount) and the count B (accumulative waste amount).

The degradation progress of toner used in electrophotographic image forming apparatuses varies depending on environments in which the apparatus is used such as temperature and humidity, manners how the apparatus operates (i.e., operating conditions such as transfer pace, and the like). Accordingly, to more properly determine the handling of collected toner, it is advantageous that manner of comparison between the counts A and B is adjusted depending on operating conditions.

A fourth embodiment described below includes such adjustment of manner of comparison between the counts A and B according to operating conditions.

It is to be noted that elements of the present embodiment similar to those of the first embodiment are given identical or similar reference characters, and thus descriptions thereof omitted.

In determining whether the collected toner is disposed or reused, the image forming apparatus 1 according to the present embodiment does not compare the count A with the count B as is, but adjusts the comparison using adjustment coefficients $\alpha$ and $\beta$ that change depending on the operating conditions. For example, the image forming apparatus 1 multiplies the count A (required waste amount) by the adjustment coefficient $\alpha$ ($\alpha\times A$), adds the adjustment coefficient $\beta$ thereto, and compares $\alpha \times A+\beta$ with the count B (accumulative waste amount). The adjustment coefficients $\alpha$ and $\beta$ affecting the count A are predetermined according to the operating conditions as shown in FIGS. 22A through 22I.

Then, according to the comparison between the counts A and B described in the first embodiment above, the switching determiner 393 determines whether collected toner is disposed or reused. Specifically, when A' represents $\alpha \times A+\beta$ (the count A multiplied by the adjustment coefficient $\alpha$ plus the adjustment coefficient $\beta$, the switching determiner 393 determines to reuse collected toner in the case of $A' \leq 0$, the switching determiner 393 determines to dispose collected toner in the case of $A'>0$ and $A'>B$, and the switching determiner 393 determines to reuse collected toner in the case of $A'>0$ and $A' \leq B$.

FIGS. 22A through 22I are example coefficient setting tables according to the present embodiment. The term "coefficient setting tables" used in this specification means tables stored in the setting data memory 394 to store values of adjustment coefficients $\alpha$ and $\beta$ designated according to the operating conditions.

Initially, descriptions are given below of changing the manner of comparison between the counts A and B according to humidity with reference to FIGS. 22A through 22I. As described above with reference to FIG. 13, in accordance with humidity, the toner degradation rate varies.

Accordingly, the image forming apparatus 1 according to the present embodiment changes the manner of comparison between the counts A and B according to humidity H (%) so that the switching determiner 393 can determine disposal or reuse of collected toner more properly.

Since the toner degradation rate tends to increase as humidity increases as described above with reference to FIG. 13, the manner of comparison between the counts A and B is changed so that the toner collecting device 325 is more likely to switch to dispose collected toner as humidity increases.

As shown in FIG. 22A, the adjustment coefficients $\alpha$ and $\beta$ are set so that, as humidity increases, the count $A'(=\alpha \times A+\beta)$ increases, that is, $A'>B$ is more likely to occur. It is to be noted that degradation progress of toner used in the present embodiment is gentler when humidity is lower than humidity of standard conditions. Therefore, as shown in FIG. 22A, the adjustment coefficients $\alpha$ and $\beta$ are set so that the degradation progress of toner becomes gentler in the case of humidity $H \leq 40$.

Further, as described above with reference to FIG. 14, the toner degradation rate varies in accordance with temperature.

Accordingly, the image forming apparatus 1 according to the present embodiment changes the manner of comparison between the counts A and B according to temperature T (° C.) so that the switching determiner 393 can determine disposal or reuse of collected toner more properly.

Since the toner degradation rate tends to increase as temperature increases as described above with reference to FIG. 14, the manner of comparison between the counts A and B is changed so that the toner collecting device 325 is more likely to switch to dispose collected toner as temperature increases.

Accordingly, as shown in FIG. 22B, the adjustment coefficients $\alpha$ and $\beta$ are set so that, as temperature increases, the count $A'(=\alpha \times A+\beta)$ increases, that is, $A'>B$ is more likely to occur. It is to be noted that degradation progress of toner used in the present embodiment is gentler when temperature is lower than temperature of standard conditions. Therefore, as shown in FIG. 22B, the adjustment coefficients $\alpha$ and $\beta$ are set so that the degradation progress of toner becomes gentler in the case of temperature $T \leq 20$.

Referring to FIG. 22C, changing the manner of comparison between the counts A and B according to the content of reused toner (reused toner amount R) is described below.

As described above with reference to FIG. 15, the toner degradation rate varies in accordance with the content of reused toner.

Accordingly, the image forming apparatus 1 according to the present embodiment adjusts the manner of comparison between the counts A and B according to the content of reused toner in toner in the developing device 323 so that the switching determiner 393 can determine disposal or reuse of collected toner more properly.

Since the toner degradation rate tends to increase as the content of reused toner increases as shown in FIG. 15, the manner of comparison between the counts A and B is changed so that the toner collecting device 325 is more likely to switch to dispose collected toner as the content of reused toner increases.

Accordingly, as shown in FIG. 22C, the adjustment coefficients $\alpha$ and $\beta$ are set so that, as the content of reused toner in toner in the developing device 323 increases, the count A' $(=\alpha \times A+\beta)$ increases, that is, $A'>B$ is more likely to occur.

Referring to FIG. 22D, changing the manner of comparison between the counts A and B according to the transfer pace (Tr) is described below. Further, as described above with reference to FIG. 16, the toner degradation rate varies in accordance with the transfer pace of toner.

Accordingly, the image forming apparatus 1 according to the present embodiment changes the manner of comparison between the counts A and B according to transfer pace so that the switching determiner 393 can determine disposal or reuse of collected toner more properly.

Since the toner degradation rate tends to increase as temperature increases as described above with reference to FIG. 16, the manner of comparison between the counts A and B is changed so that the toner collecting device 325 is more likely to switch to reuse collected toner as the transfer pace increases.

Accordingly, as shown in FIG. 22D, the adjustment coefficients $\alpha$ and $\beta$ are set so that, as the transfer pace of toner increases, the count $A'(=\alpha \times A+\beta)$ decreases, that is, $A' \leq B$ is more likely to occur.

Referring to FIG. 22E, changing the manner of comparison between the counts A and B according to the amount of paper dust (paper dust amount P) is described below.

As described above with reference to FIG. 18, the apparent degradation progress of toner varies in accordance with the amount of paper dust mixed in toner in the developing device 323.

Accordingly, the image forming apparatus 1 according to the present embodiment adjusts the manner of comparison between the counts A and B according to the amount of paper dust mixed in toner in the developing device 323 so that the switching determiner 393 can determine disposal or reuse of collected toner more properly.

Since the apparent degradation progress of toner tends to increase as the amount of paper dust mixed increases as shown in FIG. 18, the manner of comparison between the counts A and B is changed so that the toner collecting device 325 is more likely to switch to dispose collected toner as the amount of paper dust mixed increases.

Accordingly, as shown in FIG. 22E, the adjustment coefficients $\alpha$ and $\beta$ are set so that, as the amount of paper dust mixed in toner in the developing device 323 increases, the count $A'(=\alpha \times A+\beta)$ increases, that is, $A'>B$ is more likely to occur.

Further, as described above with reference to FIG. 19, the apparent degradation progress of toner varies in accordance with the smoothness of transfer sheets used in image formation.

Accordingly, the image forming apparatus 1 changes the manner of comparison between the counts A and B according to the smoothness of transfer sheets so that the switching determiner 393 can determine disposal or reuse of collected toner more properly.

Since the toner degradation rate tends to decrease as smoothness of transfer sheets used in image formation increases as described above with reference to FIG. 19, the manner of comparison between the counts A and B is changed so that the toner collecting device 325 is more likely to switch to reuse collected toner as the smoothness of transfer sheets increases.

Accordingly, as shown in FIG. 22F, the adjustment coefficients $\alpha$ and $\beta$ are set so that, as the smoothness (S) of transfer sheets increases, the count $A'(=\alpha \times A+\beta)$ decreases, that is, $A' \leq B$ is more likely to occur. It is to be noted that degradation progress of toner used in the present embodiment is gentler when the smoothness of sheets is higher than that of standard conditions. Therefore, as shown in FIG. 22F, the adjustment coefficients $\alpha$ and $\beta$ are set so that the degradation progress of toner becomes gentler in the case of humidity $10 \leq S$.

Referring to FIG. 22G, changing the manner of comparison between the counts A and B according to the driving amount (D1) of the developer conveying screws 323*a* and 323*b* is described below.

As described above with reference to FIG. 20, the toner degradation rate varies depending on the driving amount of the developer conveying screws 323*a* and 323*b*. Accordingly, the image forming apparatus 1 according to the present embodiment changes the manner of comparison between the counts A and B according to the driving amount of the developer conveying screws 323*a* and 323*b* so that the switching determiner 393 can determine disposal or reuse of collected toner more properly.

Since the toner degradation rate tends to increase as the driving amount of the developer conveying screws 323*a* and 323*b* increases as shown in FIG. 20, the manner of comparison between the counts A and B is changed so that the toner collecting device 325 is more likely to switch to dispose collected toner as the driving amount increases.

Accordingly, as shown in FIG. 22G, the adjustment coefficients $\alpha$ and $\beta$ are set so that, as the driving amount (D1) of the developer conveying screws 323*a* and 323*b* increases, the count $A'(=\alpha \times A+\beta)$ increases, that is, $A'>B$ is more likely to occur.

Referring to FIG. 22H, changing the manner of comparison between the counts A and B according to the driving amount (D2) of the collected-toner conveying screw 325*b* is described below.

As described above with reference to FIG. 21, the toner degradation rate varies depending on the driving amount of the collected-toner conveying screw 325*b*. Accordingly, the image forming apparatus 1 according to the present embodiment changes the manner of comparison between the counts A and B according to the driving amount of the collected-toner conveying screw 325*b* so that the switching determiner 393 can determine disposal or reuse of collected toner more properly.

Since the toner degradation rate increases as the driving amount of the collected-toner conveying screw 325*b* increases as described above with reference to FIG. 21, the manner of comparison between the counts A and B is changed so that the toner collecting device 325 is more likely to switch to dispose collected toner as the driving amount of the collected-toner conveying screw 325*b* increases.

Accordingly, as shown in FIG. 22H, the adjustment coefficients $\alpha$ and $\beta$ are set so that, as the driving amount (D2) of the collected-toner conveying screw 325*b* increases, the count $A'(=\alpha A+\beta)$ increases, that is, $A'>B$ is more likely to occur.

Referring to FIG. 22I, changing the manner of comparison between the counts A and B according to the amount of background fog toner (background fog amount B) is described below.

Since the background fog toner is transferred onto the transfer sheet or disposed in the waste-toner container 326 as described above, it is possible that the amount of background fog toner affects the manner of comparison between the counts A and B.

Accordingly, the image forming apparatus 1 according to the present embodiment changes the manner of comparison between the counts A and B according to background fog toner, adhering to the outer circumferential face of the photoconductor drum 321, under the operating conditions so that the switching determiner 393 can determine disposal or reuse of collected toner more properly.

Since the background fog toner is transferred onto the transfer sheet or disposed in the waste-toner container 326 as described above, the manner of comparison between the counts A and B is changed so that the toner collecting device 325 is more likely to switch to reuse collected toner as the amount of background fog toner adhering to the photoconductor drum 321 increases.

Accordingly, as shown in FIG. 22I, the adjustment coefficients $\alpha$ and $\beta$ are set so that, as the background fog amount B increases, the count $A'(=\alpha \times A+\beta)$ decreases, that is, $A' \leq B$ is more likely to occur. It is to be noted that, when the background fog amount B is greater than that under standard conditions, a greater amount of background fog toner is transferred onto the transfer sheet or disposed in the waste-toner container 326. Therefore, as shown in FIG. 22I, the adjustment coefficients $\alpha$ and $\beta$ are set to increase the tendency of switching to reuse collected toner of the toner collecting device 325 in the case of $0.3 \leq B$.

As described above, an aspect of the present embodiment is to change the manner of comparison between the counts A and B according to environmental conditions, for example, humidity and temperature under which the apparatus is used, and operating conditions, for example, the content of reused toner in toner in the developing device 323, the transfer pace, the amount of paper dust mixed in toner in the developing device 323, the smoothness of transfer sheets, the driving amount of the developer conveying screws 323*a* and 323*b*, the driving amount of the collected-toner conveying screw 325*b*, and the amount of background fog toner. Thus, the present embodiment is advantageous in properly determining whether collected toner is disposed or reused, and reducing the cost for proper switching between disposed of collected toner and reused of collected toner. With such adjustment, in the present embodiment, advantages attained by reuse of developer and image quality guarantee are better balanced.

It is to be noted that, although the descriptions above concern the case where $\alpha \times A+\beta$ is compared with the count B, that is, the adjustment coefficients $\alpha$ and $\beta$ act on the count A, alternatively, in another embodiment, the count A is compared with $\alpha \times B+\beta$, that is, the adjustment coefficients $\alpha$ and $\beta$ act on the count B. In this case, the adjustment coefficients $\alpha$ and $\beta$ are respectively set as shown in FIGS. 23A through 23I. In FIGS. 23A through 23I, the adjustment coefficients α and β are set to have the tendency opposite to that of values in FIGS. 22A through 22I.

Yet alternatively, in another embodiment, α×A is compared with β×B, that is, the adjustment coefficients α and β act on the counts A and B, respectively. In this case, the adjustment coefficients α and β are respectively set as shown in FIGS. 24A through 24I. In FIGS. 24A through 24I, the adjustment coefficient α is set to have the tendency identical to that of values in FIGS. 22A through 22I, whereas the adjustment coefficient β is set to have the opposite tendency.

Further, although the descriptions above concern the case where the adjustment coefficients α and β are set in the coefficient setting table as shown in FIGS. 22A through 22I, 23A through 23I, or 24A through 24I, alternatively, in another embodiment, formulas to calculate the adjustment coefficients α and β are set in an adjustment coefficient calculation table. The term "adjustment coefficient calculation table" used in this specification means a table stored in the setting data memory 394 to store formulas to calculate the adjustment coefficients α and β according to the operating conditions.

FIGS. 25A through 25I are example coefficient calculation tables according to the present embodiment. The adjustment coefficient calculation tables in FIGS. 25A through 25I are for a case where α×A+β is compared with B, that is, the adjustment coefficients α and β act on the count A. In FIGS. 25A through 25I, the formulas to calculate the adjustment coefficients α and β are set to obtain values having the tendency identical to that of values in FIGS. 22A through 22I.

FIGS. 26A through 26I are example coefficient calculation tables according to the present embodiment. The adjustment coefficient calculation tables in FIGS. 26A through 26I are for a case where A is compared with α×B+β, that is, the adjustment coefficients α and β act on the count B. In FIGS. 26A through 26I, the formulas to calculate the adjustment coefficients α and β are set to obtain values having the tendency identical to that of values in FIGS. 23A through 23I.

FIGS. 27A through 27I are example coefficient calculation tables according to the present embodiment. The adjustment coefficient calculation tables in FIGS. 27A and 27I are for a case where α×A is compared with β×B, that is, the adjustment coefficients α and β act on the counts A and B, respectively. In FIGS. 27A through 27I, the formulas to calculate the adjustment coefficients α and β are set to obtain values having the tendency identical to that of values in FIGS. 24A through 24I.

Additionally, although, in the descriptions above, the manner of comparison between the counts A and B is changed according to the driving amount of the developer conveying screws 323*a* and 323*b* and that of the driving amount of the collected-toner conveying screw 325*b*, as the driving amount of the developer conveying member disposed in the channel through which developer moves, in another embodiment, the manner of comparison is changed according to the driving amount of another component, such as the photoconductor drum 321, the developing roller 323*c*, or the like. In such cases, the manner of comparison is changed in a manner similar to the case where the driving amount of the developer conveying screws 323*a* and 323*b* is used because the toner degradation rate in the developing device 323 increases as the driving amount of such component increases similar to that of the developer conveying screws 323*a* and 323*b*.

Additionally, although, in FIGS. 22D through 27D, the transfer pace (Tr) is represented by weight of toner transferred in image formation per unit time (mg/sec), alternatively, "transfer pace" may be represented by weight of toner transferred in image formation per unit driving amount of the developer conveying screws 323*a* and 323*b* (mg/km).

It is to be noted that the steps in the above-described flowchart may be executed in an order different from that in the flowchart.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program and computer program product. For example, the aforementioned methods may be embodied in the form of a system or device, including, but not limited to, any of the structure for performing the methodology illustrated in the drawings.

Even further, any of the aforementioned methods may be embodied in the form of a program. The program may be stored on a computer readable media and is adapted to perform any one of the aforementioned methods when run on a computer device (a device including a processor). Thus, the storage medium or computer readable medium, is adapted to store information and is adapted to interact with a data processing facility or computer device to perform the method of any of the above mentioned embodiments.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus comprising:

an image bearer to bear a latent image;

a developing device to develop the latent image with developer;

a transfer device to transfer a developed image from the image bearer onto a recording medium;

a developer collecting device to collect developer remaining on the image bearer;

a waste-developer container to contain developer to be disposed, a switching determiner to perform:

determination of a preferred transfer amount of developer in a target period;

estimation of an accumulative consumption of developer in the target period;

determination of whether to dispose or reuse collected developer collected by the developer collecting device from the image bearer; and determination of whether to perform switching between disposal and reuse of the collected developer based on comparison between the preferred transfer amount and the estimated accumulative consumption of developer;

a switching controller to cause the developer collecting device to perform the switching between disposal and reuse according to determination made by the switching determiner;

an accumulative waste amount estimator to estimate an accumulative waste amount meaning an amount of developer disposed in the waste-developer container in the target period; and a transfer amount estimator to estimate an accumulative transfer amount in the target period, wherein the switching determiner estimates the accumulative consumption of developer based on the accumulative waste amount and the accumulative transfer amount.

2. The image forming apparatus according to claim 1, wherein the developer collecting device comprises:

a waste-developer channel through which the collected developer is transported to the waste-developer container;

a reused developer channel through which the collected developer to be reused is transported; and a channel switching member to switch a route of the collected developer between the waste-developer channel and the reused developer channel, the channel switching member controlled by the switching controller.

3. The image forming apparatus according to claim 1, wherein the switching determiner determines to dispose the collected developer when the preferred transfer amount is greater than the estimated accumulative consumption of developer, and the switching determiner determines to reuse the collected developer when the preferred transfer amount is not greater than the estimated accumulative consumption of developer.

4. The image forming apparatus according to claim 1, wherein, when the preferred transfer amount is equal to the estimated accumulative consumption of developer, the switching determiner determines not to perform the switching between disposal and reuse of the collected developer.

5. The image forming apparatus according to claim 1, further comprising:

an elapsed time counter to count an elapsed time in the target period; and a setting data memory to store a predetermined unit transfer amount meaning an amount of developer to be transferred per unit time, wherein the switching determiner determines the preferred transfer amount by multiplication of the predetermined unit transfer amount with the elapsed time in the target period, counted by the elapsed time counter.

6. The image forming apparatus according to claim 1, wherein the developing device comprises a developer conveying member to transport developer, the image forming apparatus further comprises:

a driving amount estimator to estimate a driving amount of the developer conveying member; and a setting data memory to store a predetermined unit transfer amount meaning an amount of developer to be transferred per unit driving amount of the developer conveying member, wherein the switching determiner determines the preferred transfer amount by multiplication of the predetermined unit transfer amount with the driving amount in the target period, estimated by the driving amount estimator.

7. The image forming apparatus according to claim 1, wherein the switching determiner determines a required waste amount meaning an amount of developer to be disposed in the waste-developer container in the target period, and the switching determiner determines the switching between disposal and reuse of the collected developer based on either comparison between the required waste amount and zero, or comparison between the required waste amount and the estimated accumulative waste amount.

8. The image forming apparatus according to claim 7, wherein the switching controller determines to reuse the collected developer when the required waste amount is equal to or smaller than zero.

9. The image forming apparatus according to claim 7, wherein the switching determiner determines to dispose the collected developer when the required waste amount is greater than the accumulative waste amount and determines to reuse the collected developer when the required waste amount is not greater than the accumulative waste amount.

10. The image forming apparatus according to claim 7, wherein, when the required waste amount is equal to the accumulative waste amount, the switching determiner determines not to perform the switching between disposal and reuse of the collected developer.

11. The image forming apparatus according to claim 7, wherein the required waste amount is calculated based on the preferred transfer amount and the accumulative transfer amount.

12. The image forming apparatus according to claim 7, wherein the switching determiner adjusts the required waste amount according to an operating condition of the image forming apparatus.

13. The image forming apparatus according to claim 7, wherein, in comparing the required waste amount and the accumulative waste amount, the switching determiner multiplies at least one of the required waste amount and the accumulative waste amount by a coefficient that changes according to an operating condition of the image forming apparatus.

14. The image forming apparatus according to claim 13, further comprising a setting data memory to store a coefficient setting table in which values of the coefficient are set according to the operating condition, wherein the switching determiner refers to the coefficient setting table to determine the coefficient.

15. The image forming apparatus according to claim 13, further comprising a setting data memory to store a coefficient calculation table to designate a calculation formula of the coefficient according to the operating condition, wherein the switching determiner refers to the coefficient calculation table to determine the coefficient.

16. The image forming apparatus according to claim 1, further comprising a waste developer detector to detect disposal of the collected developer in the waste-developer container, wherein the accumulative waste amount estimator estimates the accumulative waste amount according to a detection signal generated by the waste developer detector.

17. The image forming apparatus according to claim 1, wherein the accumulative waste amount estimator calculates at least one of:

an amount of developer remaining in an image area of the image bearer after the developed image is transferred from the image bearer;

an amount of developer remaining outside the image area of the image bearer after the developed image is transferred from the image bearer; and an amount of adjustment developer caused to adhere to the image bearer in adjustment, and the accumulative waste amount estimator estimates the accumulative waste amount as a sum of the at least one of the amount of developer remaining in the image area, the amount of developer remaining outside the image area, and the amount of adjustment developer.

18. The image forming apparatus according to claim 1, wherein the accumulative waste amount estimator adjusts the accumulative waste amount according to an operating condition of the image forming apparatus.

19. The image forming apparatus according to claim 1, wherein the developer collecting device comprises:

a waste-developer channel through which the collected developer is transported to the waste-developer container;

a reused developer channel through which the collected developer to be reused is transported;

a collected-developer channel that bifurcates into the waste-developer channel and the reused developer channel;

a collected-developer conveying member to transport the collected developer and disposed in the collected-developer channel; and a channel switching member to switch a conveyance route of collected developer between the waste-developer channel and the reused developer channel, the channel switching member controlled by the switching controller, the accumulative waste amount estimator adjusts the accumulative waste amount according to at least one of:

a driving amount of the collected-developer conveying member;

an amount of the collected developer that flows to the reused developer channel when the channel switching member sets the conveyance route of collected developer to the waste-developer channel; and an amount of the collected developer that flows to the waste developer channel when the channel switching member sets the conveyance route of collected developer to the reused developer channel.

* * * * *